US010451079B2

(12) United States Patent
Chang et al.

(10) Patent No.: US 10,451,079 B2
(45) Date of Patent: Oct. 22, 2019

(54) ELECTRIC SUBMERSIBLE PUMP COMPONENTS

(71) Applicant: Schlumberger Technology Corporation, Sugar Land, TX (US)

(72) Inventors: Lye Heng Chang, Singapore (SG); Jerome Ang Sze Jiunn, Singapore (SG); Kean Wee Cheah, Singapore (SG); David Milton Eslinger, Collinsville, OK (US); Ruslan Alexandrovich Bobkov, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 473 days.

(21) Appl. No.: 15/117,726

(22) PCT Filed: Feb. 11, 2015

(86) PCT No.: PCT/US2015/015314

§ 371 (c)(1),
(2) Date: Aug. 9, 2016

(87) PCT Pub. No.: WO2015/123236

PCT Pub. Date: Aug. 20, 2015

(65) Prior Publication Data

US 2017/0167498 A1 Jun. 15, 2017

Related U.S. Application Data

(60) Provisional application No. 61/938,698, filed on Feb. 12, 2014, provisional application No. 61/949,122, filed on Mar. 6, 2014.

(51) Int. Cl.
*F04D 29/22* (2006.01)
*F04D 29/44* (2006.01)
(Continued)

(52) U.S. Cl.
CPC ..... *F04D 29/041* (2013.01); *E21B 43/128* (2013.01); *E21B 43/2406* (2013.01);
(Continued)

(58) Field of Classification Search
CPC ..... F04D 1/06; F04D 13/086; F04D 13/10; F04D 25/0686; F04D 29/20; F04D 29/2216; F04D 29/448; F04D 29/628
See application file for complete search history.

(56) References Cited

U.S. PATENT DOCUMENTS 2,066,505 A * 1/1937 Wolfe ..... F04D 29/167 210/513
2,775,945 A * 1/1957 Arutunoff ..... F04D 13/10 415/172.1
(Continued)

FOREIGN PATENT DOCUMENTS

GB 200230 A * 7/1923 ..... B63C 3/08
WO WO2015023636 A1 2/2015
WO WO2015108624 A1 7/2015

OTHER PUBLICATIONS

PCT/US2015/015314 International Search Report and Written Opinion, dated May 22, 2015, 14 pgs.
(Continued)

*Primary Examiner* — Ninh H. Nguyen

(57) ABSTRACT

An electric submersible pump (ESP) can include a shaft; an electric motor configured to rotatably drive the shaft; a housing; a stack of diffusers disposed in the housing; and impellers operatively coupled to the shaft. Various other apparatuses, systems, methods, etc., are also disclosed.

20 Claims, 17 Drawing Sheets

(51) Int. Cl.

| | |
|---|---|
| ***F04D 29/041*** | (2006.01) |
| ***F04D 13/10*** | (2006.01) |
| ***E21B 43/12*** | (2006.01) |
| ***E21B 43/24*** | (2006.01) |
| ***F04D 1/06*** | (2006.01) |
| ***F04D 29/62*** | (2006.01) |
| ***F04D 29/042*** | (2006.01) |
| ***F04D 29/20*** | (2006.01) |

(52) U.S. Cl.
CPC ..... *F04D 1/06* (2013.01); *F04D 1/063* (2013.01); *F04D 13/10* (2013.01); *F04D 29/042* (2013.01); *F04D 29/0416* (2013.01); *F04D 29/20* (2013.01); *F04D 29/2261* (2013.01); *F04D 29/445* (2013.01); *F04D 29/628* (2013.01)

(56) References Cited

U.S. PATENT DOCUMENTS

| | | | | |
|---|---|---|---|---|
| 3,011,446 | A * | 12/1961 | Tsiguloff | F04D 13/10 415/191 |
| 5,845,709 | A * | 12/1998 | Mack | E21B 43/128 166/302 |
| 6,012,900 | A | 1/2000 | Kennedy et al. | |
| 6,106,224 | A | 8/2000 | Sheth et al. | |
| 7,575,413 | B2 * | 8/2009 | Semple | F04D 1/063 415/107 |
| 8,287,235 | B2 | 10/2012 | Orban et al. | |
| 8,568,081 | B2 | 10/2013 | Song et al. | |
| 9,494,164 | B2 * | 11/2016 | Baski | E21B 41/0085 |
| 2011/0058928 | A1 | 3/2011 | Sheth et al. | |

OTHER PUBLICATIONS

International Preliminary Report on Patentability issued in related PCT application PCT/US2015/015314 dated Aug. 16, 2016, 11 pages.

* cited by examiner

ELECTRIC SUBMERSIBLE PUMP COMPONENTS

CROSS-REFERENCE TO RELATED APPLICATIONS

The present document is based on and claims priority to U.S. Provisional Application No. 61/938,698, filed Feb. 12, 2014, and to U.S. Provisional Application No. 61/949,122, filed Mar. 6, 2014, each of which are incorporated herein by reference in its entirety.

BACKGROUND

An electric submersible pump (ESP) can include a stack of impeller and diffuser stages where the impellers are operatively coupled to a shaft driven by an electric motor. Various forces exist during operation as fluid is propelled from lower stages to upper stages of the ESP stack. Various technologies, techniques, etc. described herein may help to balance forces between two or more stages.

SUMMARY

In general, components for an electric submersible pump and an electric submersible pump having a shaft, an electric motor configured to rotatably drive the shaft, a housing, a stack of diffusers disposed on the housing, and impellers operatively coupled to the shaft are disclosed.

However, many modifications are possible without materially departing from the teachings of this disclosure. Accordingly, such modifications are intended to be included within the scope of this disclosure as defined in the claims.

BRIEF DESCRIPTION OF THE DRAWINGS

Features and advantages of the described implementations can be more readily understood by reference to the following description taken in conjunction with the accompanying drawings.

DETAILED DESCRIPTION

The following description includes the best mode presently contemplated for practicing the described implementations. This description is not to be taken in a limiting sense, but rather is made merely for the purpose of describing the general principles of the implementations. The scope of the described implementations should be ascertained with reference to the issued claims.

Figure 1:
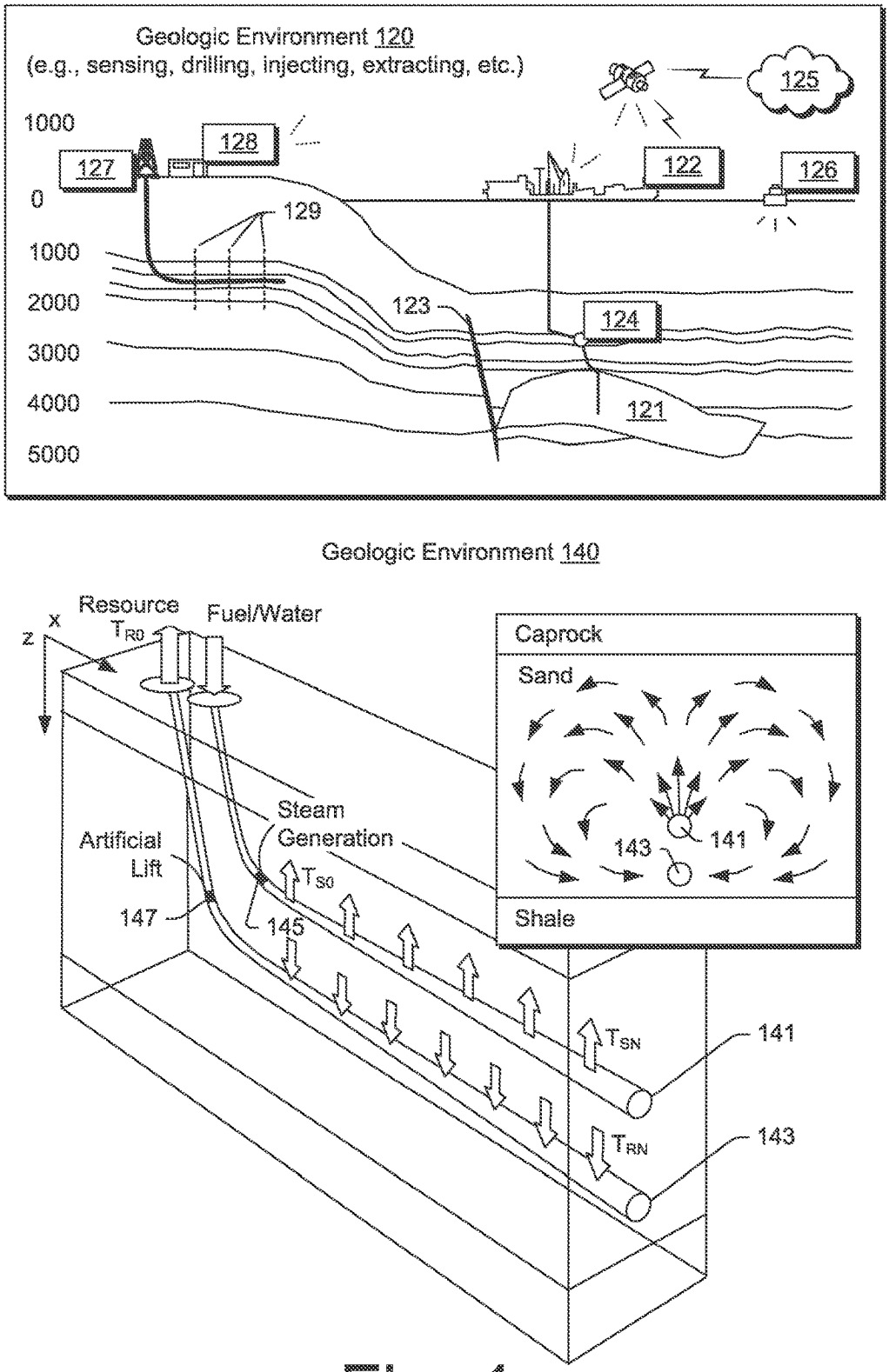
FIG. 1 illustrates examples of equipment in geologic environments.

FIG. 1 shows examples of geologic environments 120 and 140. In FIG. 1, the geologic environment 120 may be a sedimentary basin that includes layers (e.g., stratification) that include a reservoir 121 and that may be, for example, intersected by a fault 123 (e.g., or faults). As an example, the geologic environment 120 may be outfitted with any of a variety of sensors, detectors, actuators, etc. For example, equipment 122 may include communication circuitry to receive and to transmit information with respect to one or more networks 125. Such information may include information associated with downhole equipment 124, which may be equipment to acquire information, to assist with resource recovery, etc. Other equipment 126 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 125 that may be configured for communications, noting that the satellite may additionally or alternatively include circuitry for imagery (e.g., spatial, spectral, temporal, radiometric, etc.).

FIG. 1 also shows the geologic environment 120 as optionally including equipment 127 and 128 associated with a well that includes a substantially horizontal portion that may intersect with one or more fractures 129. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop the reservoir (e.g., via fracturing, injecting, extracting, etc.). As an example, the equipment 127 and/or 128 may include components, a system, systems, etc. for fracturing, seismic sensing, analysis of seismic data, assessment of one or more fractures, etc.

As to the geologic environment 140, as shown in FIG. 1, it includes two wells 141 and 143 (e.g., bores), which may be, for example, disposed at least partially in a layer such as a sand layer disposed between caprock and shale. As an example, the geologic environment 140 may be outfitted with equipment 145, which may be, for example, steam assisted gravity drainage (SAGD) equipment for injecting steam for enhancing extraction of a resource from a reservoir. SAGD is a technique that involves subterranean delivery of steam to enhance flow of heavy oil, bitumen, etc. SAGD can be applied for Enhanced Oil Recovery (EOR), which is also known as tertiary recovery because it changes properties of oil in situ.

As an example, a SAGD operation in the geologic environment 140 may use the well 141 for steam-injection and the well 143 for resource production. In such an example, the equipment 145 may be a downhole steam generator and the equipment 147 may be an electric submersible pump (e.g., an ESP).

As illustrated in a cross-sectional view of FIG. 1, steam injected via the well 141 may rise in a subterranean portion of the geologic environment and transfer heat to a desirable resource such as heavy oil. In turn, as the resource is heated, its viscosity decreases, allowing it to flow more readily to the well 143 (e.g., a resource production well). In such an example, equipment 147 (e.g., an ESP) may then assist with lifting the resource in the well 143 to, for example, a surface facility (e.g., via a wellhead, etc.). As an example, where a production well includes artificial lift equipment such as an ESP, operation of such equipment may be impacted by the presence of condensed steam (e.g., water in addition to a desired resource). In such an example, an ESP may experience conditions that may depend in part on operation of other equipment (e.g., steam injection, operation of another ESP, etc.).

Conditions in a geologic environment may be transient and/or persistent. Where equipment is placed within a geologic environment, longevity of the equipment can depend on characteristics of the environment and, for example, duration of use of the equipment as well as function of the equipment. Where equipment is to endure in an environment over a significant period of time, uncertainty may arise in one or more factors that could impact integrity or expected lifetime of the equipment. As an example, where a period of time may be of the order of decades, equipment that is intended to last for such a period of time may be constructed to endure conditions imposed thereon, whether imposed by an environment or environments and/or one or more functions of the equipment itself.

Figure 2:
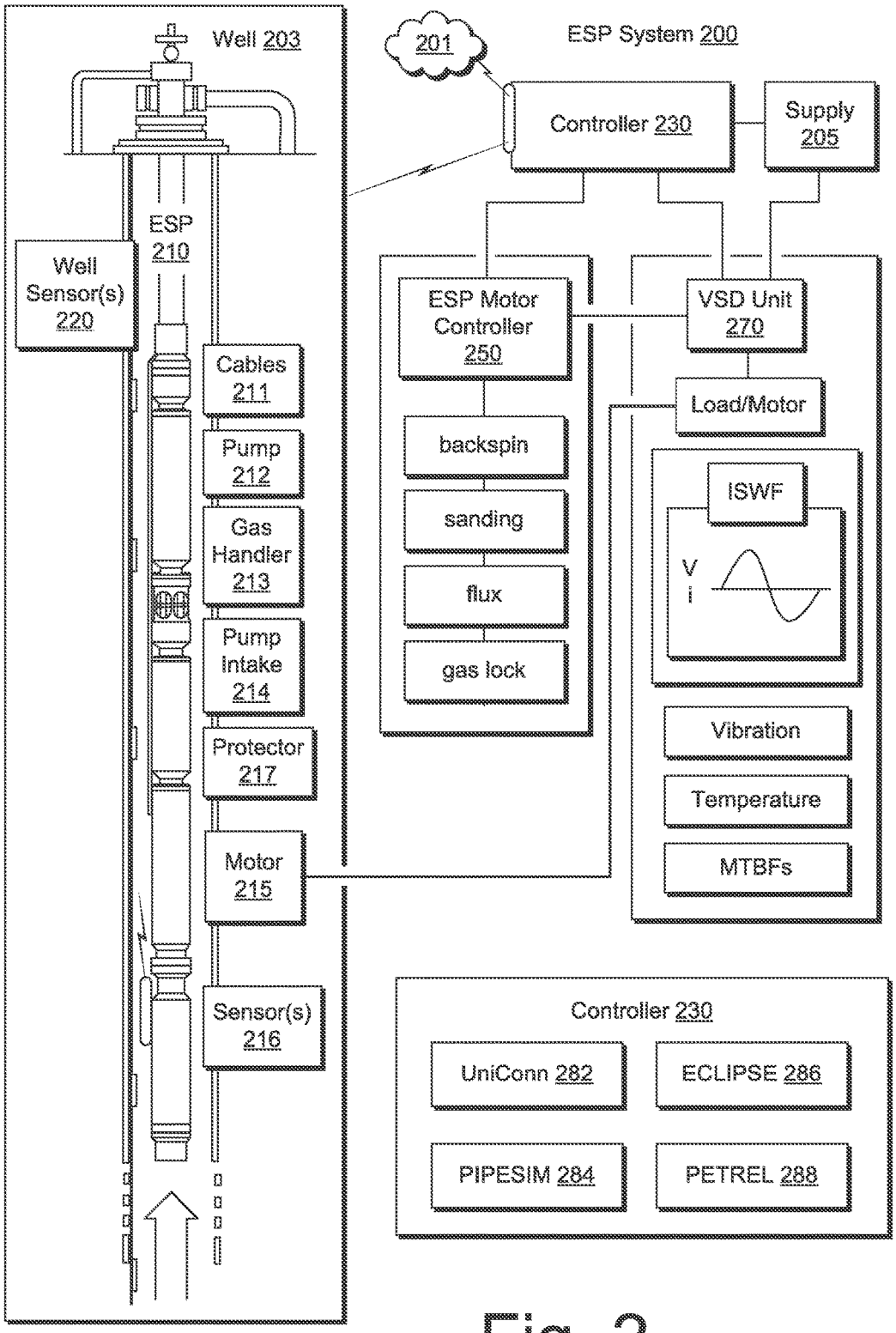
FIG. 2 illustrates an example of an electric submersible pump system.

FIG. 2 shows an example of an ESP system 200 that includes an ESP 210 as an example of equipment that may be placed in a geologic environment. As an example, an ESP may be expected to function in an environment over an extended period of time (e.g., optionally of the order of years). As an example, commercially available ESPs (such as the REDA™ ESPs marketed by Schlumberger Limited, Houston, Tex.) may find use in applications that call for, for example, pump rates in excess of about 4,000 barrels per day and lift of about 12,000 feet or more.

In the example of FIG. 2, the ESP system 200 includes a network 201, a well 203 disposed in a geologic environment (e.g., with surface equipment, etc.), a power supply 205, the ESP 210, a controller 230, a motor controller 250 and a VSD unit 270. The power supply 205 may receive power from a power grid, an onsite generator (e.g., natural gas driven turbine), or other source. The power supply 205 may supply a voltage, for example, of about 4.16 kV.

As shown, the well 203 includes a wellhead that can include a choke (e.g., a choke valve). For example, the well 203 can include a choke valve to control various operations such as to reduce pressure of a fluid from high pressure in a closed wellbore to atmospheric pressure. Adjustable choke valves can include valves constructed to resist wear due to high-velocity, solids-laden fluid flowing by restricting or sealing elements. A wellhead may include one or more sensors such as a temperature sensor, a pressure sensor, a solids sensor, etc.

As to the ESP 210, it is shown as including cables 211 (e.g., or a cable), a pump 212, gas handling features 213, a pump intake 214, a motor 215, one or more sensors 216 (e.g., temperature, pressure, strain, current leakage, vibration, etc.) and optionally a protector 217.

As an example, an ESP may include a REDA™ Hotline high-temperature ESP motor. Such a motor may be suitable for implementation in a thermal recovery heavy oil production system, such as, for example, SAGD system or other steam-flooding system.

As an example, an ESP motor can include a three-phase squirrel cage with two-pole induction. As an example, an ESP motor may include steel stator laminations that can help focus magnetic forces on rotors, for example, to help reduce energy loss. As an example, stator windings can include copper and insulation.

In the example of FIG. 2, the well 203 may include one or more well sensors 220, for example, such as the commercially available OpticLine™ sensors or WellWatcher BriteBlue™ sensors marketed by Schlumberger Limited (Houston, Tex.). Such sensors are fiber-optic based and can provide for real time sensing of temperature, for example, in SAGD or other operations. As shown in the example of FIG. 1, a well can include a relatively horizontal portion. Such a portion may collect heated heavy oil responsive to steam injection. Measurements of temperature along the length of the well can provide for feedback, for example, to understand conditions downhole of an ESP. Well sensors may extend thousands of feet into a well (e.g., 4,000 feet or more) and beyond a position of an ESP.

In the example of FIG. 2, the controller 230 can include one or more interfaces, for example, for receipt, transmission or receipt and transmission of information with the motor controller 250, a VSD unit 270, the power supply 205 (e.g., a gas fueled turbine generator, a power company, etc.), the network 201, equipment in the well 203, equipment in another well, etc.

As shown in FIG. 2, the controller 230 may include or provide access to one or more modules or frameworks. Further, the controller 230 may include features of an ESP motor controller and optionally supplant the ESP motor controller 250. For example, the controller 230 may include the UniConn™ motor controller 282 marketed by Schlumberger Limited (Houston, Tex.). In the example of FIG. 2, the controller 230 may access one or more of the PIPESIM™ framework 284, the ECLIPSE™ framework 286 marketed by Schlumberger Limited (Houston, Tex.) and the PETREL™ framework 288 marketed by Schlumberger Limited (Houston, Tex.) (e.g., and optionally the OCEAN™ framework marketed by Schlumberger Limited (Houston, Tex.)).

In the example of FIG. 2, the motor controller 250 may be a commercially available motor controller such as the UniConn™ motor controller. The UniConn™ motor controller can connect to a SCADA system, the espWatcher™ surveillance system, etc. The UniConn™ motor controller can perform some control and data acquisition tasks for ESPs, surface pumps or other monitored wells. The UniConn™ motor controller can interface with the Phoenix™ monitoring system, for example, to access pressure, temperature and vibration data and various protection parameters as well as to provide direct current power to downhole sensors. The UniConn™ motor controller can interface with fixed speed drive (FSD) controllers or a VSD unit, for example, such as the VSD unit 270.

For FSD controllers, the UniConn™ motor controller can monitor ESP system three-phase currents, three-phase surface voltage, supply voltage and frequency, ESP spinning frequency and leg ground, power factor and motor load.

For VSD units, the UniConn™ motor controller can monitor VSD output current, ESP running current, VSD output voltage, supply voltage, VSD input and VSD output power, VSD output frequency, drive loading, motor load, three-phase ESP running current, three-phase VSD input or output voltage, ESP spinning frequency, and leg-ground.

In the example of FIG. 2, the ESP motor controller 250 includes various modules to handle, for example, backspin of an ESP, sanding of an ESP, flux of an ESP and gas lock of an ESP. The motor controller 250 may include any of a variety of features, additionally, alternatively, etc.

In the example of FIG. 2, the VSD unit 270 may be a low voltage drive (VSD) unit, a medium voltage drive (MVD) unit or other type of unit (e.g., a high voltage drive, which may provide a voltage in excess of about 4.16 kV). As an example, the VSD unit 270 may receive power with a voltage of about 4.16 kV and control a motor as a load with a voltage from about 0 V to about 4.16 kV. The VSD unit 270 may include commercially available control circuitry such as the SpeedStar™ MVD control circuitry marketed by Schlumberger Limited (Houston, Tex.).

Figure 3:
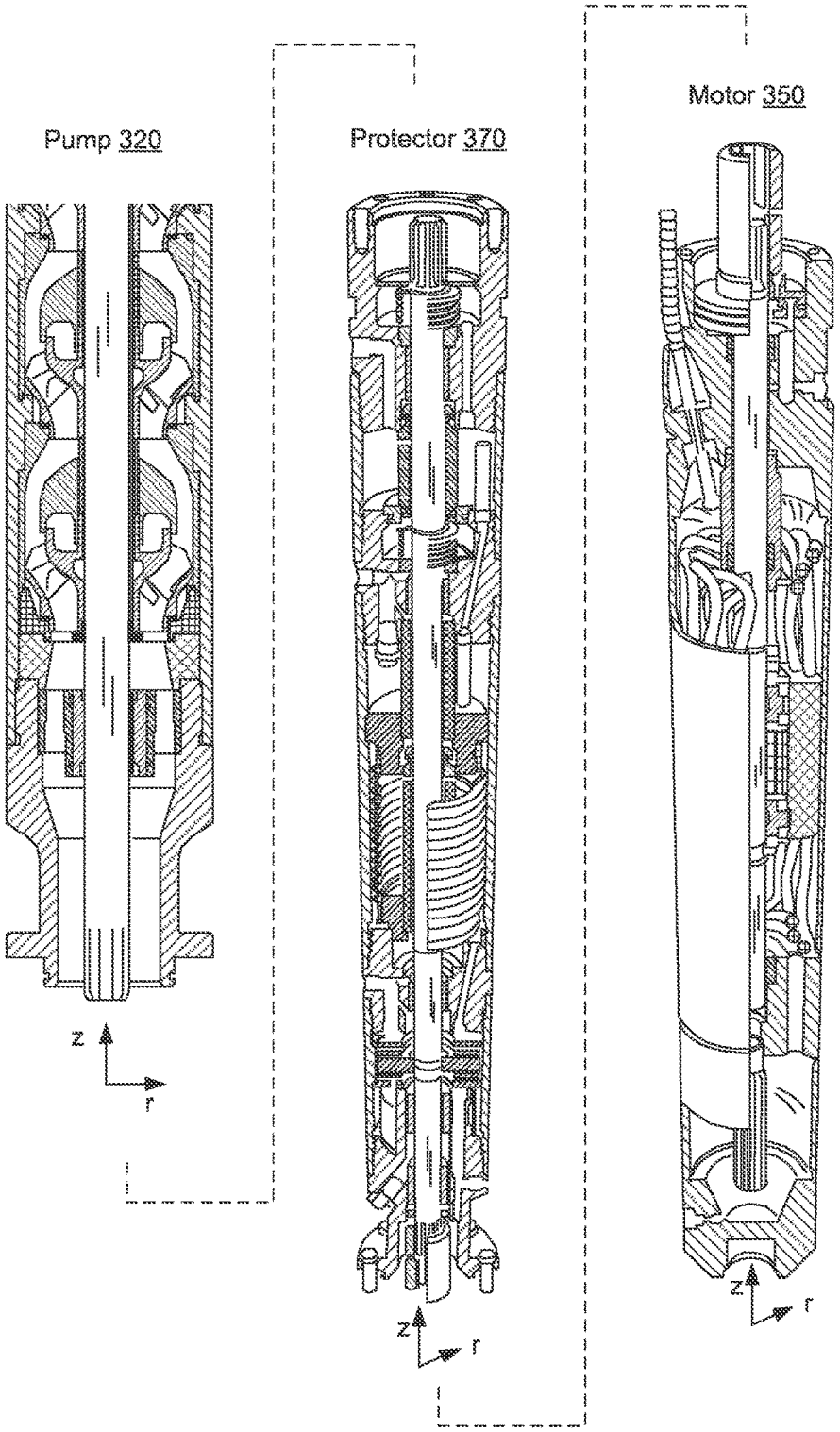
FIG. 3 illustrates examples of equipment.

FIG. 3 shows cut-away views of examples of equipment such as, for example, a portion of a pump 320, a protector 370 and a motor 350 of an ESP. The pump 320, the protector 370 and the motor 350 are shown with respect to cylindrical coordinate systems (e.g., r, z, Θ). Various features of equipment may be described, defined, etc. with respect to a cylindrical coordinate system. As an example, a lower end of the pump 320 may be coupled to an upper end of the protector 370 and a lower end of the protector 370 may be coupled to an upper end of the motor 350. As shown in FIG. 3, a shaft segment of the pump 320 may be coupled via a connector to a shaft segment of the protector 370 and the shaft segment of the protector 370 may be coupled via a connector to a shaft segment of the motor 350. As an example, an ESP may be oriented in a desired direction, which may be vertical, horizontal or other angle. Orientation of an ESP with respect to gravity may be considered as a factor, for example, to determine ESP features, operation, etc.

Figure 4:
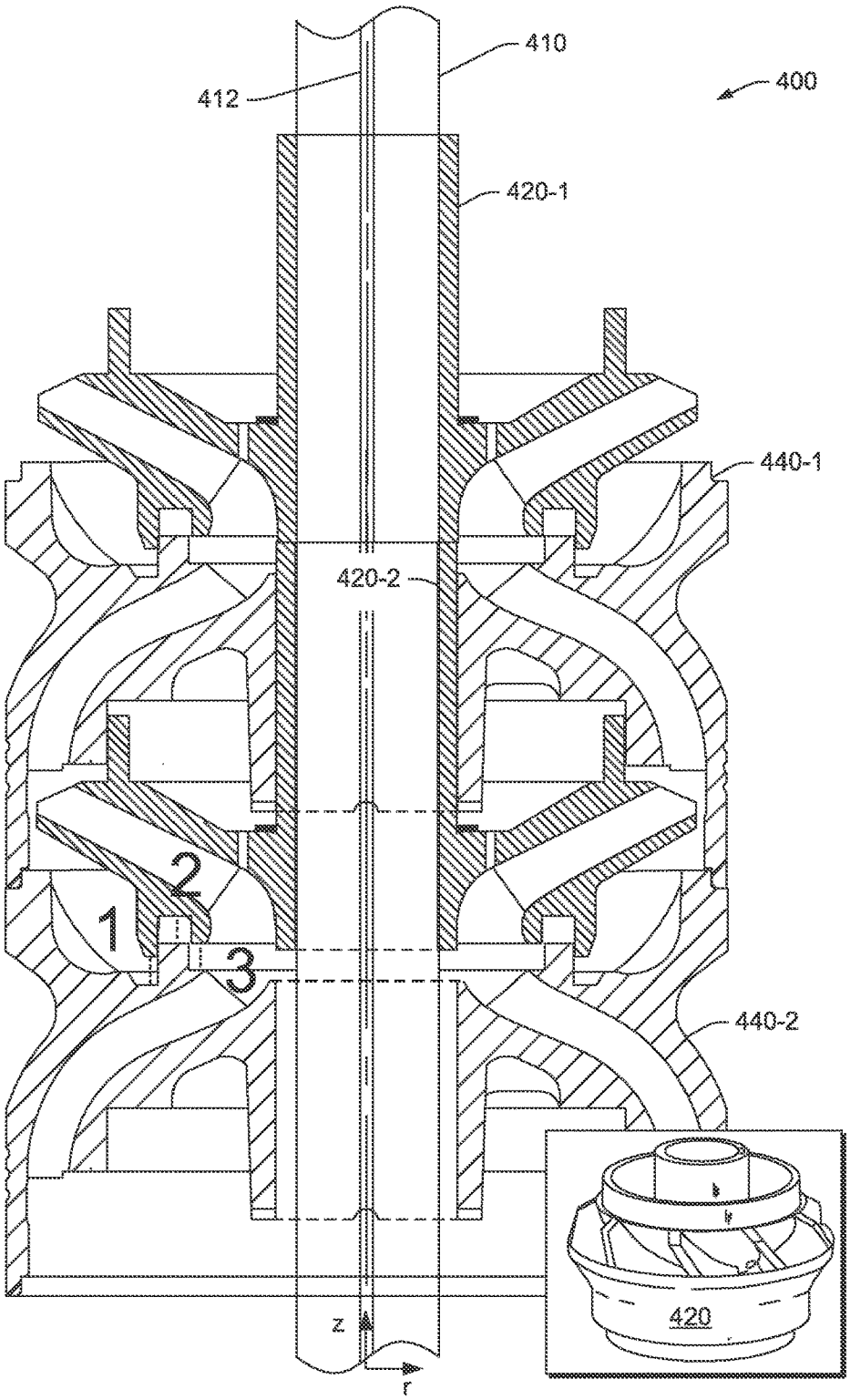
FIG. 4 illustrates an example of components of a pump.

FIG. 4 shows a cutaway view of an assembly 400 that includes a shaft 410 with a keyway 412 that may be fit with a key where components are stacked along the shaft 410. As shown in the example of FIG. 4, the components include an impeller 420-1, a diffuser 440-1, another impeller 420-2 and another diffuser 440-1. FIG. 4 also shows a perspective view of an impeller 420. In the example of FIG. 4, the impellers 420-1 and 420-2 may contact each other, for example, directly along hub portions or, for example, indirectly via a hub spacer (e.g., an impeller spacer). As shown, the diffusers 440-1 and 440-2 may contact each other, for example, directly along outer wall portions or, for example, indirectly via a diffuser spacer.

During operation, the assembly 400 acts to drive fluid in an upward direction, for example, axially upwardly with respect to the shaft 410. In an individual stage formed by an impeller and a diffuser, flow of fluid may be "mixed" with respect to direction. For example, fluid may flow radially as well as axially due to configuration of an impeller and a diffuser in a stage.

FIG. 4 shows four axial clearances between the impeller 420-2 and the diffuser 440-2, which are labeled 1, 2 and 3, moving from an outer radial position to an inner radial position.

Figure 5A:
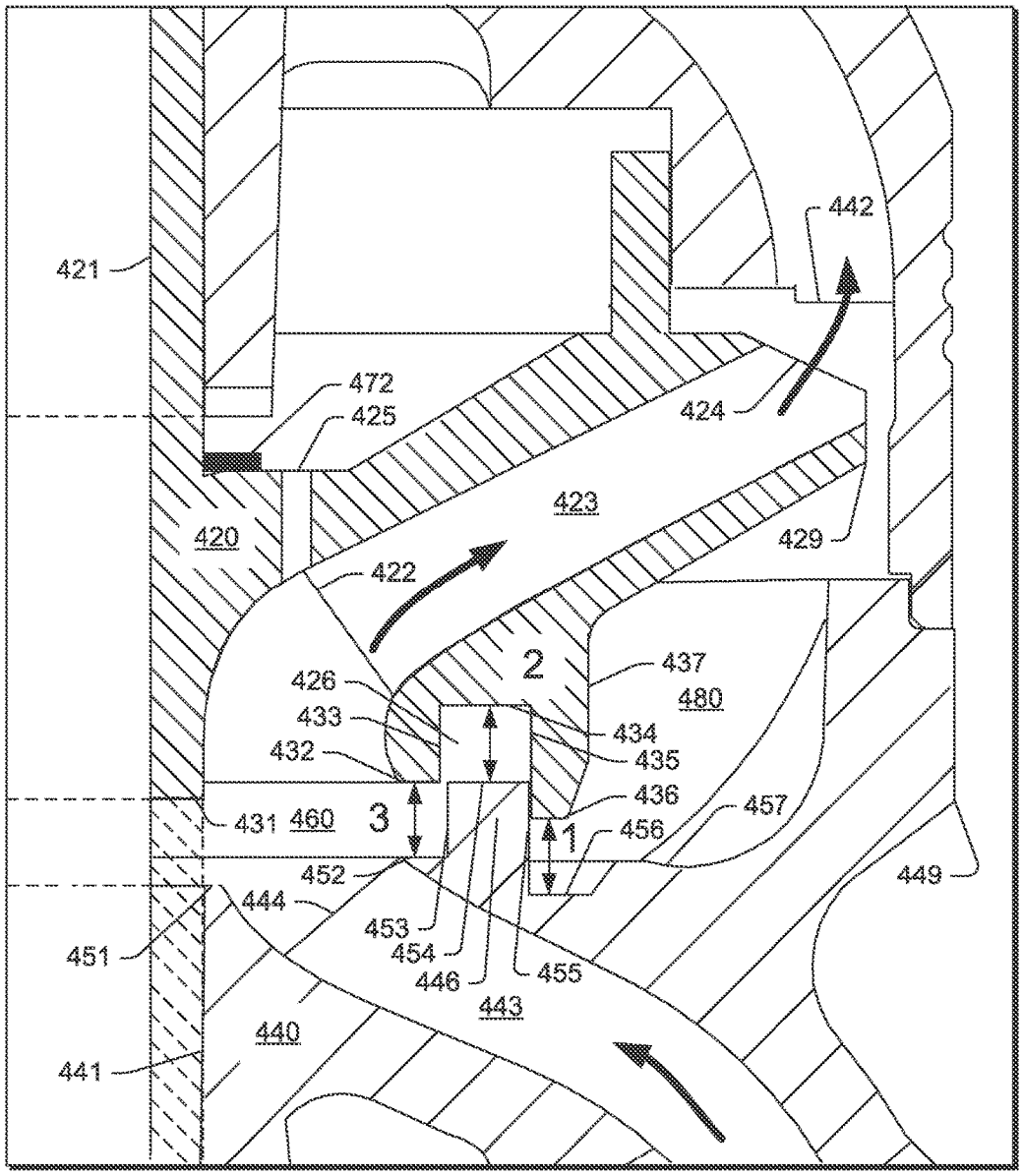
FIG. 5A illustrates an enlarged view of a portion of the example of FIG. 4.

FIG. 5A shows an enlarged cutaway view of a portion of the assembly 400 of FIG. 4. As shown in FIG. 5A, the impeller 420 includes an inner surface 421 at an inner radius (e.g., an inner diameter) and an outer surface 429 at an outer radius (e.g., an outer diameter). The impeller 420 includes vanes or blades 423 that extend from a leading edge 422 to a trailing edge 424. During operation, as the impeller 420 rotates (e.g., due to the impeller 420 being operatively coupled to the shaft 410), fluid flows in throats defined by adjacent vanes 423 from the leading edge 422 to the trailing edge 424. Also shown in the example of FIG. 5A are a component 472, which may be a thrust washer, and a passage 425 in the impeller 420, which may be a pressure balancing passage. The component 472 may be an annular component (e.g., a washer) that sits on a shoulder of the impeller 420 and the impeller 420 may include a plurality of passages such as the passage 425 (see, e.g., the perspective view of the impeller 420 of FIG. 4).

As shown in FIG. 5A, the diffuser 440 includes an inner surface 441 at an inner radius (e.g., an inner diameter) and an outer surface 449 at an outer radius (e.g., an outer diameter). As indicated by dashed lines, another impeller (e.g., a hub portion) or an impeller spacer may be disposed proximate to the inner surface 441 of the diffuser 440. Between the inner and outer radii, the diffuser 440 includes vanes or blades 443 that extend from a leading edge 442 (see upper diffuser) to a trailing edge 444 (see lower diffuser). In the example of FIG. 5A, during operation, the diffuser 440, configured to be substantially statically disposed in a housing (e.g., in a diffuser stack), can direct flow of fluid to the leading edges 422 of the vanes 423 of the impeller 420. Specifically, the leading edge of the vanes 443 of the diffuser 440 may receive fluid from a lower impeller such that fluid is directed in throats defined by adjacent vanes 443 of the diffuser 440 toward the trailing edges 444 of the vanes 443 of the diffuser 440 and then onward toward leading edges 422 of the vanes 423 of the impeller 420.

Figure 5B:
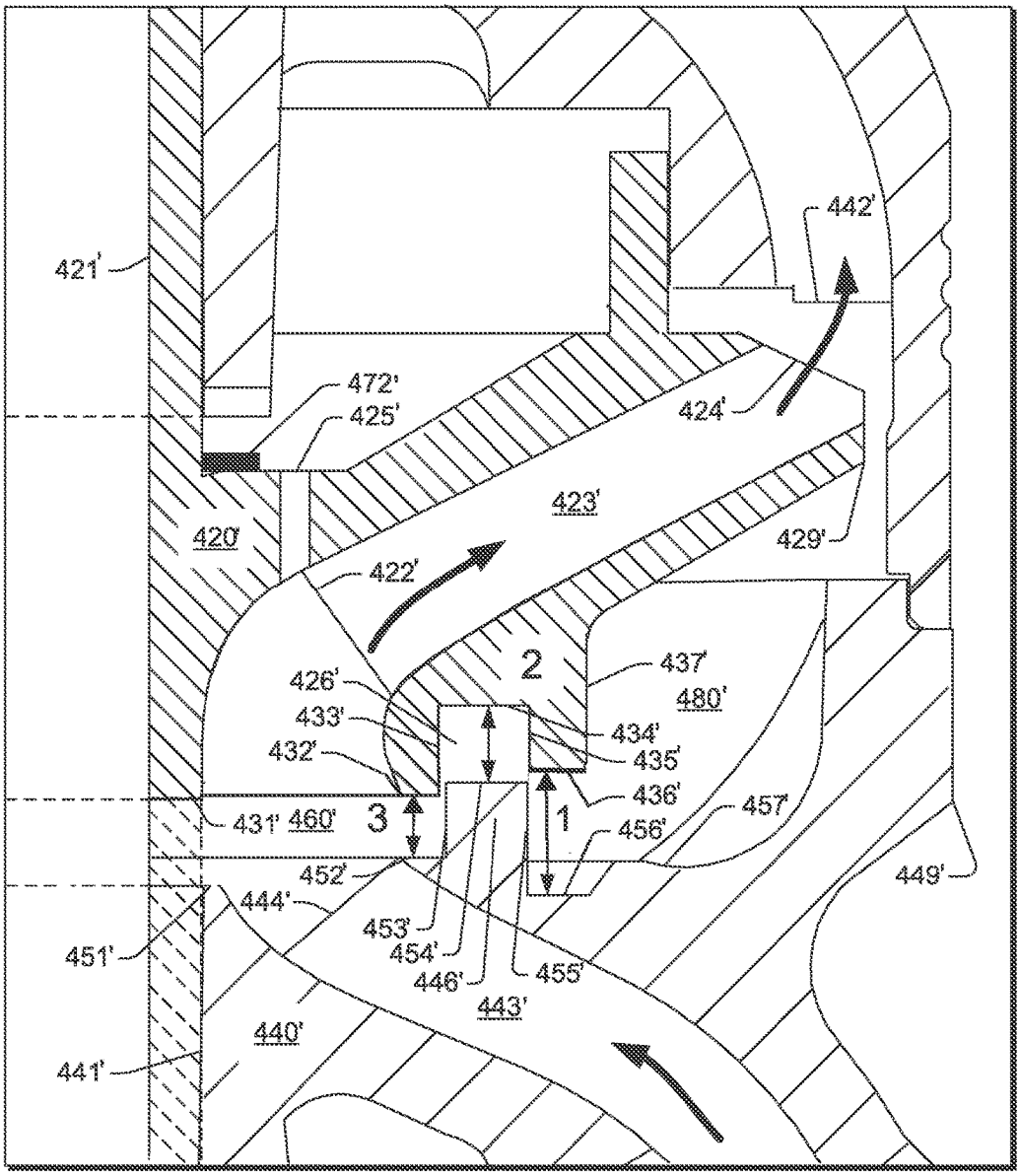
FIG. 5B illustrates an enlarged view of a portion of components of a pump.

FIG. 5B shows an enlarged cutaway view of a portion of an assembly similar to that shown in FIG. 4. As shown in FIG. 5B, the impeller 420' includes an inner surface 421' at an inner radius (e.g., an inner diameter) and an outer surface 429' at an outer radius (e.g., an outer diameter). The impeller 420' includes vanes or blades 423' that extend from a leading edge 422' to a trailing edge 424'. During operation, as the impeller 420' rotates (e.g., due to the impeller 420' being operatively coupled to the shaft 410'), fluid flows in throats defined by adjacent vanes 423' from the leading edge 422' to the trailing edge 424'. Also shown in the example of FIG. 5B are a component 472', which may be a thrust washer, and a passage 425' in the impeller 420', which may be a pressure balancing passage. The component 472' may be an annular component (e.g., a washer) that sits on a shoulder of the impeller 420' and the impeller 420' may include a plurality of passages such as the passage 425' (see, e.g., the perspective view of the impeller 420 of FIG. 4).

As shown in FIG. 5B, the diffuser 440' includes an inner surface 441' at an inner radius (e.g., an inner diameter) and an outer surface 449' at an outer radius (e.g., an outer diameter). As indicated by dashed lines, another impeller (e.g., a hub portion) or an impeller spacer may be disposed proximate to the inner surface 441' of the diffuser 440'. Between the inner and outer radii, the diffuser 440' includes vanes or blades 443' that extend from a leading edge 442' (see upper diffuser) to a trailing edge 444' (see lower diffuser). In the example of FIG. 5B, during operation, the diffuser 440', configured to be substantially statically disposed in a housing (e.g., in a diffuser stack), can direct flow of fluid to the leading edges 422' of the vanes 423' of the impeller 420'. Specifically, the leading edge of the vanes 443' of the diffuser 440' may receive fluid from a lower impeller such that fluid is directed in throats defined by adjacent vanes 443' of the diffuser 440' toward the trailing edges 444' of the vanes 443' of the diffuser 440' and then onward toward leading edges 422' of the vanes 423' of the impeller 420'.

In FIGS. 5A and 5B, arrows show a general direction of fluid flow, for example, where such fluid flows radially inwardly in diffuser throats and radially outwardly in impeller throats while progressing axially upwardly.

Returning to FIG. 5A, impeller 420 includes lower surfaces 431, 432, 433, 434, 435, 436 and 437. Referring to the diffuser 440, it includes upper surfaces 451, 452, 453, 454, 455, 456 and 457. The surfaces 432 and 452, 433 and 453, 434 and 454, 435 and 455 and 436 and 456 may be opposing surfaces while the surfaces 437 and 457 may be surfaces that define, at least in part, an outer chamber 480. During operation, the outer chamber 480 may be a high pressure chamber when compared to an inner chamber 460, which exists radially between the shaft 410 and a ridge 446 of the diffuser 440 and axially between the trailing edges 444 of the vanes 443 of the diffuser 440 and the leading edges 422 of the vanes 423 of the impeller 420. In the example of FIG. 5A, an intermediate chamber 426 exists, for example, as defined by the surfaces 433, 434 and 435 of the impeller 420 and the surface 454 of the ridge 446 of the diffuser 440.

In FIG. 5B, impeller 420' includes lower surfaces 431', 432', 433', 434', 435', 436' and 437'. Referring to the diffuser 440', it includes upper surfaces 451', 452', 453', 454', 455', 456' and 457'. The surfaces 432' and 452', 433' and 453', 434' and 454', 435' and 455' and 436' and 456' may be opposing surfaces while the surfaces 437' and 457' may be surfaces that define, at least in part, an outer chamber 480'. During operation, the outer chamber 480' may be a high pressure chamber when compared to an inner chamber 460', which exists radially between the shaft 410' and a ridge 446' of the diffuser 440' and axially between the trailing edges 444' of the vanes 443' of the diffuser 440' and the leading edges 422' of the vanes 423' of the impeller 420'. In the example of FIG. 5B, an intermediate chamber 426' exists, for example, as defined by the surfaces 433', 434' and 435' of the impeller 420' and the surface 454' of the ridge 446' of the diffuser 440'.

As mentioned with respect to FIG. 4, various clearances exist, which are labeled 1, 2 and 3. As shown in FIG. 5A, these clearances correspond to opposing surfaces 436 and 456 (clearance 1), 434 and 454 (clearance 2) and 432 and 452 (clearance 3), respectively. As shown, the clearance 1 is associated with the outer chamber 480, the clearance 2 is associated with the intermediate chamber 426 and the clearance 3 is associated with the inner chamber 460. As shown in FIG. 5B, these clearances correspond to opposing surfaces 436' and 456' (clearance 1), 434' and 454' (clearance 2) and 432' and 452' (clearance 3), respectively. As shown, clearance 1 is associated with the outer chamber 480', the clearance 2 is associated with the intermediate chamber 426' and the clearance 3 is associated with the inner chamber 460'.

Figure 6A:
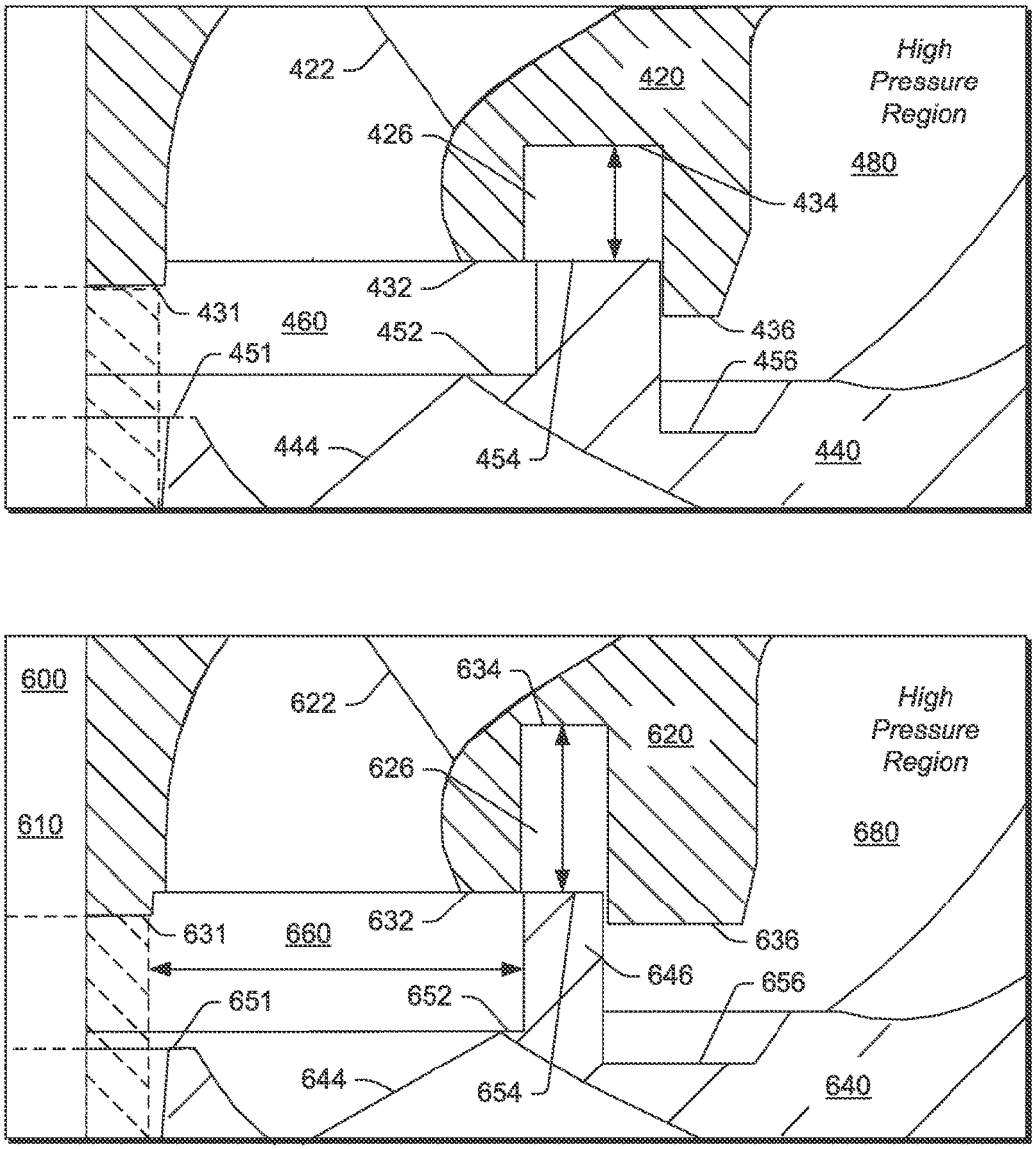
FIG. 6A illustrates an example of components of a pump.

FIG. 6A shows a cutaway view of a portion of the assembly 400 of FIGS. 4 and 5A along with a cutaway view of a portion of an assembly 600, which includes a shaft 610, an impeller 620 and a diffuser 640. As shown in FIG. 6A, the impeller 620 includes a leading edge 622 of a vane and surfaces 631, 632, 634 and 636. As shown in FIG. 6A, the diffuser 640 includes a trailing edge 644 of a vane, surfaces 651, 652, 654 and 656 and a ridge 646, which may be defined by, for example, an inner radius, an outer radius and an axial height. The various surfaces may define, at least in part, respective chambers, including an inner chamber 660, an intermediate chamber 626 and an outer chamber 680. During operation of the assembly 600, in general, the outer chamber 680 has a higher fluid pressure than the inner chamber 660 (e.g., through which fluid flows from throats of the diffuser 640 to throats of the impeller 620).

A comparison of the chambers 480, 426 and 460 of the assembly 400 to the chambers 680, 626 and 660 of the assembly 600 shows that the assembly 600 has a larger outer chamber, an axially deeper intermediate chamber and an inner chamber that may have one or more different dimensions.

As to the outer chamber 680, it is enlarged compared to the outer chamber 480 by positioning of the ridge 646 radially inward towards the inner chamber 660. As an example, the ridge 646 may act to form a seal with respect to the intermediate chamber 626, for example, along an inner radius of the ridge 646 and an inner radius of the intermediate chamber 626. As the assembly 600 has a larger outer chamber, which may be considered a high fluid pressure chamber, the assembly 600 may be more "balanced" with respect to forces that may act upon the components.

As to the dimensions of the intermediate chamber 626 and the ridge 646, these may be selected as to a "piston" effect. For example, the ridge 646 may be considered as an annular piston that is received in an annular chamber. In such an example, fluid in the annular chamber may be compressed by movement of the ridge 646 axially into the annular chamber; noting that during operation, the walls that define the annular chamber rotate (e.g., as driven by the impeller 620 being operatively coupled to the shaft 610). As the ridge 646 progresses axially into the intermediate chamber 626 (e.g., by axial movement of the impeller 620, the diffuser 640 or both the impeller 620 and the diffuser 640), compression of fluid trapped in the intermediate chamber 626 may increase pressure forces that can counteract the one or more forces that are acting to cause the progression of the ridge 646. As an example, the "piston" effect may be tailored based on clearances between surfaces of the impeller 620 that define, in part, the intermediate chamber 626 and surfaces of the ridge 646 of the diffuser 640.

Figure 6B:
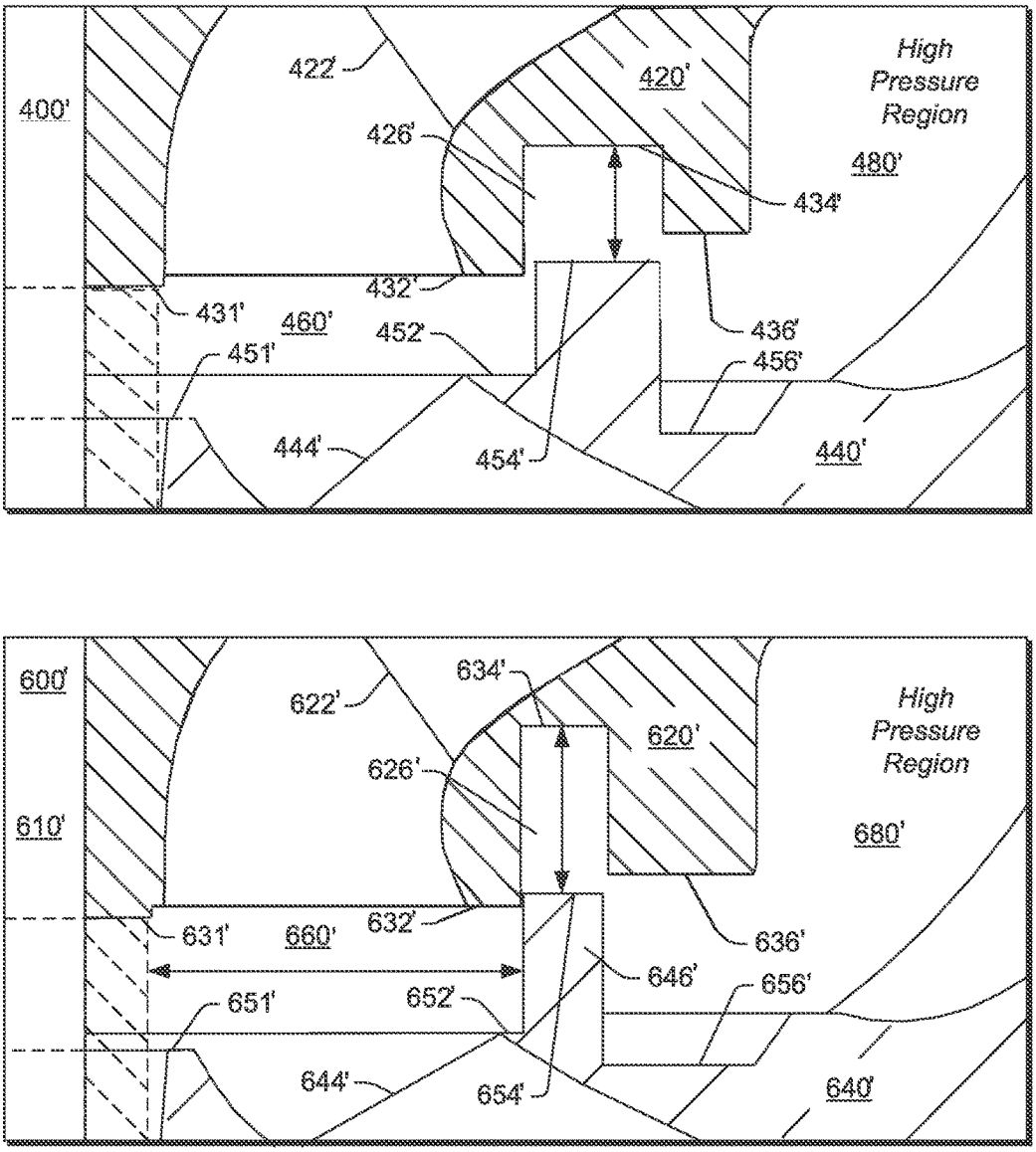
FIG. 6B illustrates an example of components of a pump.

FIG. 6B shows a cutaway view of a portion of an assembly similar to that shown in FIGS. 4 and 5B along with a cutaway view of a portion of an assembly 600', which includes a shaft 610', an impeller 620' and a diffuser 640'. As shown in FIG. 6B, the impeller 620' includes a leading edge 622' of a vane and surfaces 631', 632', 634' and 636'. As shown in FIG. 6B, the diffuser 640' includes a trailing edge 644' of a vane, surfaces 651', 652', 654' and 656' and a ridge 646', which may be defined by, for example, an inner radius, an outer radius and an axial height. The various surfaces may define, at least in part, respective chambers, including an inner chamber 660', an intermediate chamber 626' and an outer chamber 680'. During operation of the assembly 600', in general, the outer chamber 680' has a higher fluid pressure than the inner chamber 660' (e.g., through which fluid flows from throats of the diffuser 640' to throats of the impeller 620').

A comparison of the chambers 480', 426' and 460' of the assembly 400' to the chambers 680', 626' and 660' of the assembly 600' shows that the assembly 600' has a larger outer chamber, an axially deeper intermediate chamber and an inner chamber that may have one or more different dimensions.

As to the outer chamber 680', it is enlarged compared to the outer chamber 480' by positioning of the ridge 646' radially inward towards the inner chamber 660'. As an example, the ridge 646' may act to form a seal with respect to the intermediate chamber 626', for example, along an inner radius of the ridge 646' and an inner radius of the intermediate chamber 626'. As the assembly 600' has a larger outer chamber, which may be considered a high fluid pressure chamber, the assembly 600' may be more "balanced" with respect to forces that may act upon the components.

As to the dimensions of the intermediate chamber 626' and the ridge 646', these may be selected as to a "piston"

effect. For example, the ridge 646' may be considered as an annular piston that is received in an annular chamber. In such an example, fluid in the annular chamber may be compressed by movement of the ridge 646' axially into the annular chamber; noting that during operation, the walls that define the annular chamber rotate (e.g., as driven by the impeller 620' being operatively coupled to the shaft 610'). As the ridge 646' progresses axially into the intermediate chamber 626' (e.g., by axial movement of the impeller 620', the diffuser 640' or both the impeller 620' and the diffuser 640'), compression of fluid trapped in the intermediate chamber 626' may increase pressure forces that can counteract the one or more forces that are acting to cause the progression of the ridge 646'. As an example, the "piston" effect may be tailored based on clearances between surfaces of the impeller 620' that define, in part, the intermediate chamber 626' and surfaces of the ridge 646' of the diffuser 640'.

As an example, a pump may include one or more dimensions that provide for clearances. As an example, such clearances may be defined with respect to a diameter of a pump, for example, an outer diameter of a pump. As an example, such clearances may be gaps between components, for example, gaps between an impeller and a diffuser, which may be, for example, axial gaps. For example, Table 1 below illustrates an example of clearances (e.g., minimum gap) between an impeller and a diffuser with respect to pump outer diameter.

TABLE 1

| | Examples of minimum gap between impeller and diffuser (inch) | | | | | | |
|---|---|---|---|---|---|---|---|
| Pump OD | Gap E1 | Gap E2 | Gap E3 | Gap E4 | Gap E5 | Gap E6 | Gap E7 |
| <4.50" | 0.085 | 0.095 | 0.12 | 0.15 | 0.18 | 0.21 | 0.25 |
| 4.5 to 5.5" | 0.085 | 0.095 | 0.12 | 0.15 | 0.18 | 0.21 | 0.25 |
| >5.5" | 0.095 | 0.105 | 0.135 | 0.165 | 0.195 | 0.225 | 0.25 |

As indicated in Table 1, a specified minimum gap may increase with respect to increasing outer diameter of a pump. In Table 1, seven examples are given with respect to criteria as to pump outer diameter. The values therein may be considered ranges, for example, where each example includes values within the ranges. As an example, the gaps given in Table 1 may represent gaps between material of an impeller and material of an adjacent diffuser, for example, without a washer that may be disposed therebetween (e.g., in a pump assembly). As an example, an impeller and/or a diffuser may be made of metal, alloy, ceramic or other material. As an example, a pump may be defined in part by a minimum impeller to diffuser gap (e.g., consider "2" in FIG. 4), which may be defined based at least in part on outer diameter of a pump. As an example, a pump may be defined based at least in part on an axial height of a feature of component (e.g., a ridge) and/or an axial depth of a feature of a component (e.g., a slot). In a pump, as assembled, such components may be arranged according to a minimum gap, as an axial distance between a surface of a feature of one component (e.g., a ridge of an impeller) and a surface of a feature of another component (e.g., a slot of a diffuser).

As an example, a pump may include stages that include one or more slot aspect ratios. As an example, a pump may include one or more thrust washers, which may be considered "wide" thrust washers, for example, that may be implemented for a particular slot aspect ratio (e.g., consider a slot aspect ratio of about 1). As an example, as to slot aspect ratio or ratios, a pump may include one or more ratios that depend on an outer diameter or other dimension of a pump. For example, as explained with respect to Table 1, clearances, gaps, etc. may be specified with respect to a dimension such as outer diameter of a pump.

As an example, a pump may include one or more dimensions that provide for clearances. As an example, such clearances may be defined with respect to a diameter of a pump, for example, an outer diameter of a pump. As an example, such clearances may be gaps between components, for example, gaps between an impeller and a diffuser, which may be for example, axial gaps. For example, an axial gap may be the distance between surfaces 434' and 454' in FIG. 5B. For example, Table 2 below illustrates an example of clearances (e.g., minimum gap) between an impeller and a diffuser with respect t pump outer diameter.

TABLE 2

| | Examples of minimum gap between impeller and diffuser (inch) | | | | | | |
|---|---|---|---|---|---|---|---|
| Pump OD | Gap E8 | Gap E9 | Gap E10 | Gap E11 | Gap E12 | Gap E13 | Gap E14 |
| <4.50" | 0.2125 | 0.2375 | 0.30 | 0.375 | 0.45 | 0.525 | 0.625 |
| 4.5 to 5.5" | 0.2125 | 0.2375 | 0.30 | 0.375 | 0.45 | 0.525 | 0.625 |
| >5.5" | 0.2375 | 0.2625 | 0.3375 | 0.4125 | 0.4875 | 0.5625 | 0.625 |

As indicated in Table 2, a specified minimum gap may increase with respect to increasing outer diameter of a pump. In Table 2, seven examples are given with respect to criteria as to puter pump diameter. The values therein may be considered ranges, for example, where each example include values within the ranges. As an example, the gaps given in Table 2 may represent gaps between material of an impeller and material of an adjacent diffuser. As an example, a pump may be defined based at least in part of an axial height of a feature of a component (e.g., a ridge) and/or an axial depth of a feature of a component (e.g., a slot). In a pump, as assembled, such components may be arranged according to a minimum gap, as an axial distance between a surface of a feture of one component (e.g., a ridge of an impeller) and a surface of a feature of another component (e.g., a slot of a diffuser). As an example, the minimum gap (e.g., any of Gap E1-E14) may relate to the distance between surface 434 of impeller 420 and surface 454 of diffuser 440, as shown in FIG. 5A, or between surface 434' of impeller 420' and surface 454' of diffuser 440', as shown in FIG. 5B.

Figure 7:
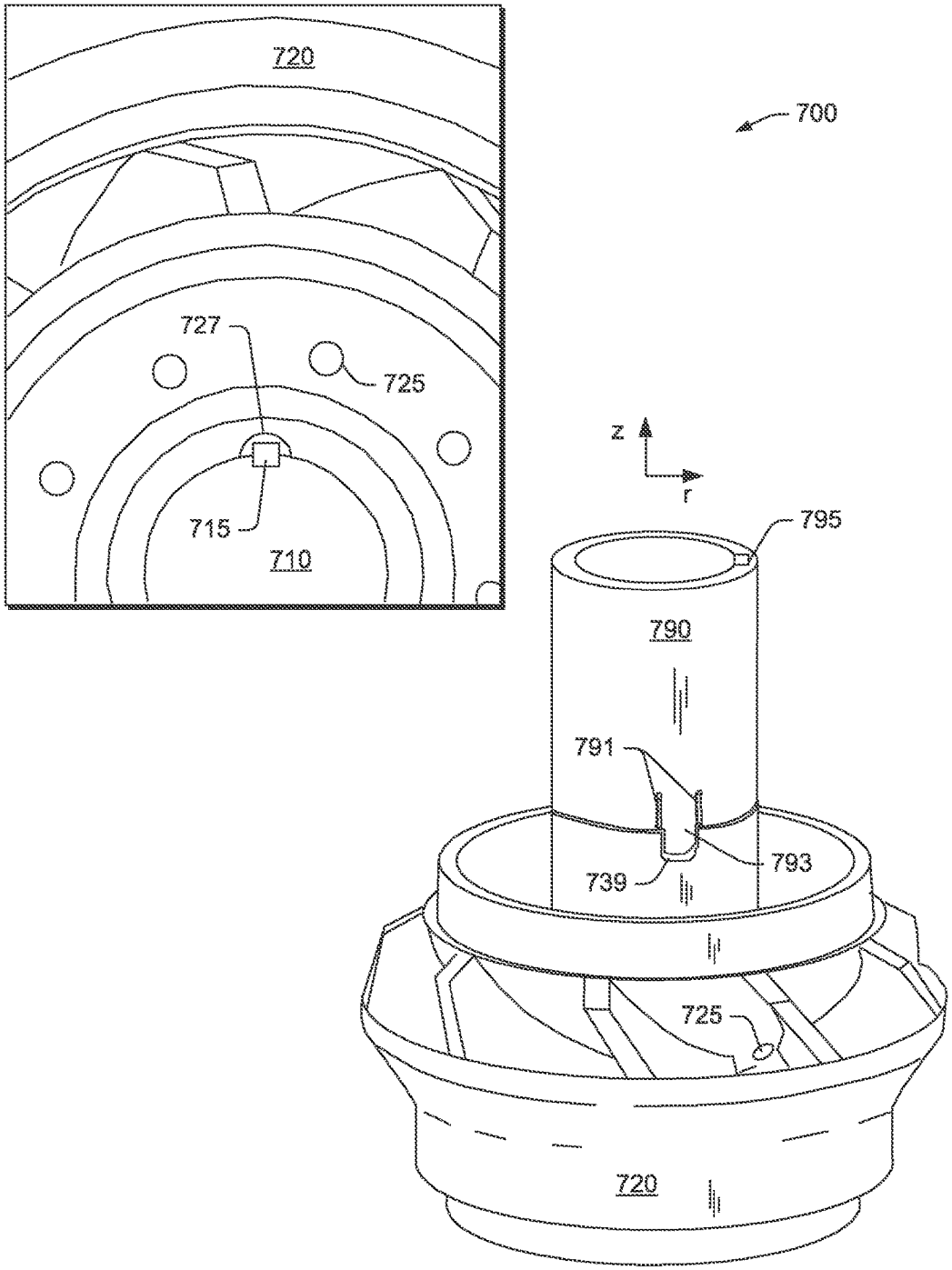
FIG. 7 illustrates an example of an assembly that includes an impeller.

FIG. 7 shows a top view and a perspective view of components of an assembly 700. In FIG. 7, the top view shows an impeller 720 that includes a cutout 727 along an inner surface that can accept a portion of a key 716 that is seated with respect to a shaft 710. Also shown are a series of passages 725, which may act to balance pressure. In FIG. 7, the perspective view shows the impeller 720 with respect to a spacer 790 that includes a tongue 793 with side recesses 791, which may allow for side-to-side flexing of the tongue 793 with respect to the spacer 790. As shown, the tongue 793 is received by a slot 739 of the impeller 720. The tongue 793 as received by the slot 739 may provide for transmission of torque from the spacer 790 to the impeller 720. For example, the spacer 790 may include a keyway 795 for receipt of the key 715 to thereby rotate the spacer 790 responsive to rotation of the shaft 710. In such an arrangement, torque may be transferred to the impeller 720 via the tongue 793 where, for example, the cutout 727 may reduce contact between the impeller 720 and the key 715. Where the key 715 is made of a hard metal (e.g., or alloy) and the impeller 720 is made of ceramic (e.g., composite material, etc.), the features may help avoid damage to the impeller 720 by the key 715.

As mentioned, an impeller may include one or more balance passages, for example, that couple an interior space of an impeller to an exterior space, for example, defined by the impeller and an adjacent diffuser. In the example of FIG. 7, fluid may flow from an opening of the passage 725 as shown in the perspective view of the impeller 720 to an opening of the passage 725 as shown in the top view of the impeller 720.

Figure 8:
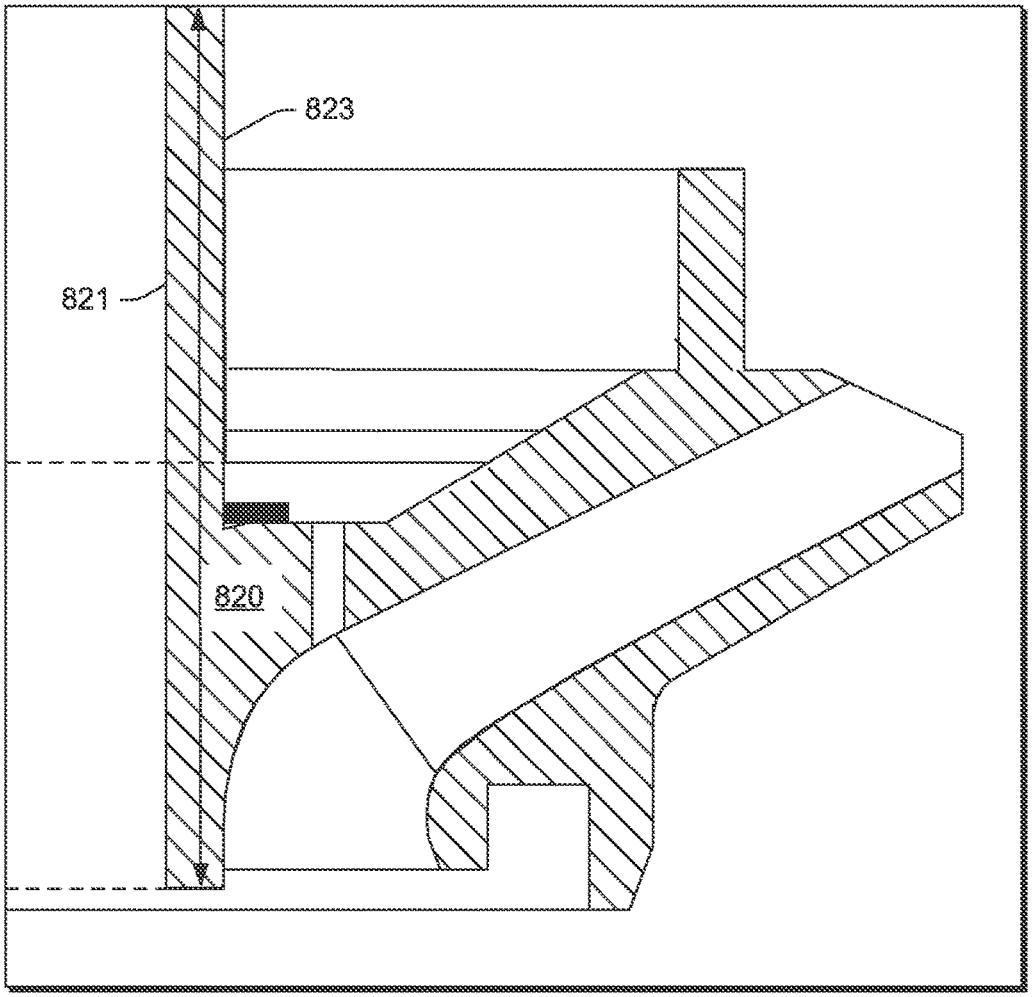
FIG. 8 illustrates an example of an impeller.

FIG. 8 shows a cutaway view of an impeller 820 that includes a cylindrical wall between an inner surface 821 at an inner radius and an outer surface 823 at an outer radius. The cylindrical wall may be referred to as a hub, for example, from which portions of the impeller 820 extend radially outwardly. As an example, a hub may experience certain axial forces that are not directly experienced by other portions of the impeller 820. As an example, a hub or a portion of a hub of an impeller may be made of a material that has a stiffness that may be greater than that of other portions of the impeller 820. For example, where an impeller is formed of a ceramic, the ceramic may be modified (e.g., via an additive, via fibers, via particles, via chemical treatment, via heat treatment, etc.) to form the impeller with a higher stiffness along the hub.

As an example, an impeller may include a hub where the hub may be an integral hub of an impeller formed as a unitary component. As an example, an impeller may include a truncated hub, for example, for use with a hub spacer that may be made of a material that is stiffer than the material from which the truncate hub is made. As an example, a hub spacer may be made of a material such as, for example, SS304 or a ceramic. As an example, an impeller (e.g., a truncated impeller) may be formed of a material such as, for example, Ni-resist (e.g., cast iron that includes graphite in a matrix of austenite).

Figure 9:
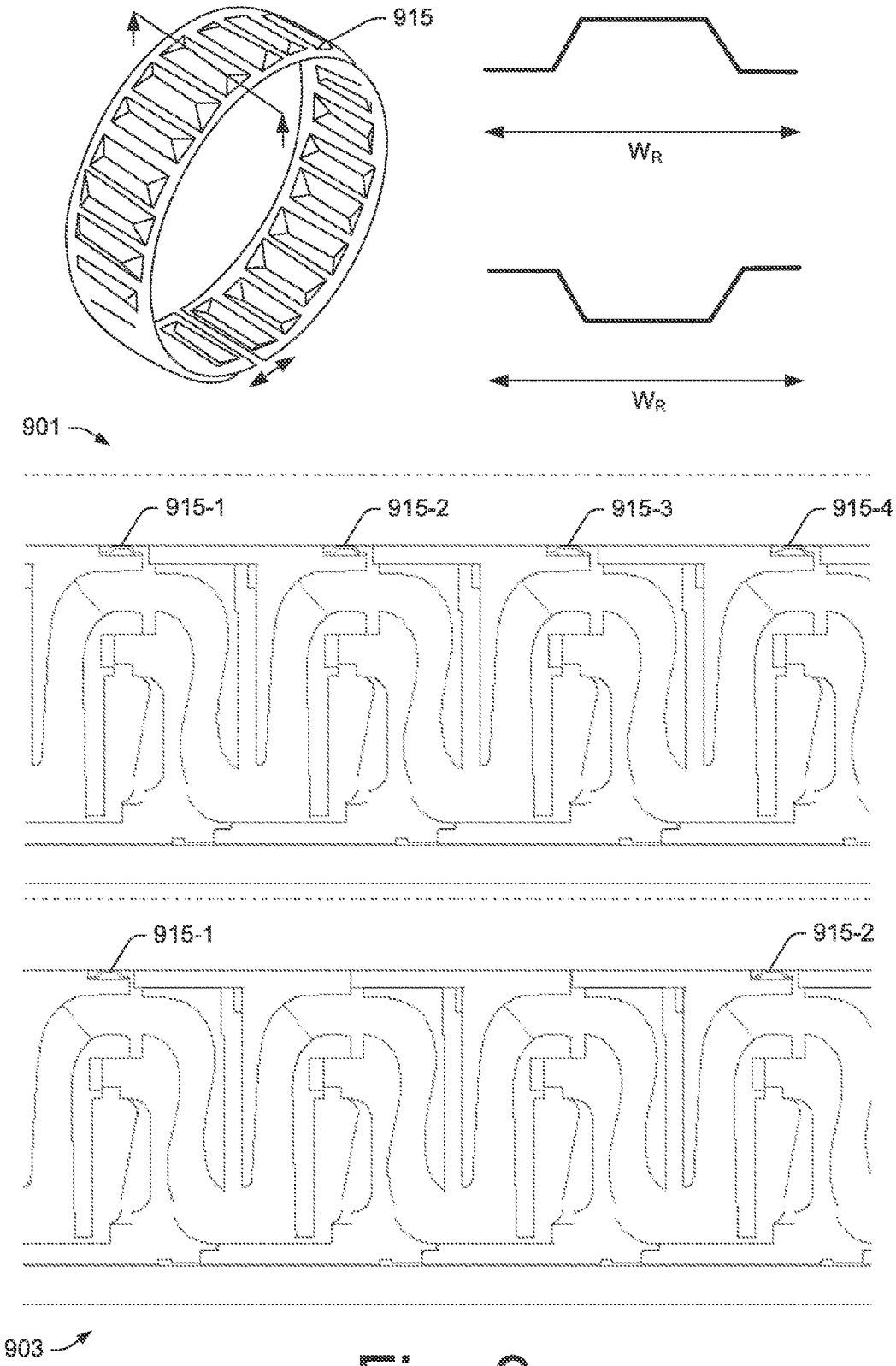
FIG. 9 illustrates examples of assemblies.

FIG. 9 shows an example of a ring 915 that may be used in an assembly such as the example assembly 901 or the example assembly 903. The ring 915 may be a tolerance ring and may be configured with outwardly facing features (e.g., "BN"), inwardly facing features (e.g., "AN") or a combination of outwardly facing features and inwardly facing features. In the assembly 901, the rings 915 include inwardly facing features that are disposed between a component and a shaft of the assembly 901. In the assembly 903, the rings 915 include inwardly facing features that are disposed between a component and a shaft of the assembly 903.

As an example, impellers may be frictionally coupled to a pump shaft so that the impellers can slide to achieve proper axial location relative to diffusers during pump assembly. In such an example, the frictional force between the impellers and shaft may be selected to be greater than an impeller axial force so that, during operation, the impeller axial may be transferred to, for example, a protector bearing or other structure of an assembly. Such an approach may be considered to be, as an example, a hybrid approach with various characteristics of a floater construction and various characteristics of a compression construction.

As example, a tolerance ring with an inner diameter of about 0.69 inch and a maximum diameter of about 0.75 inch may be used in an assembly that includes a shaft with an outer diameter of about 0.69 inch. As an example, an assembly may include tolerance rings, for example, as an alternative to key and shaft keyway for torque transmission (e.g., where each impeller includes a tolerance ring or rings as shown in the assembly 901).

Figure 10:
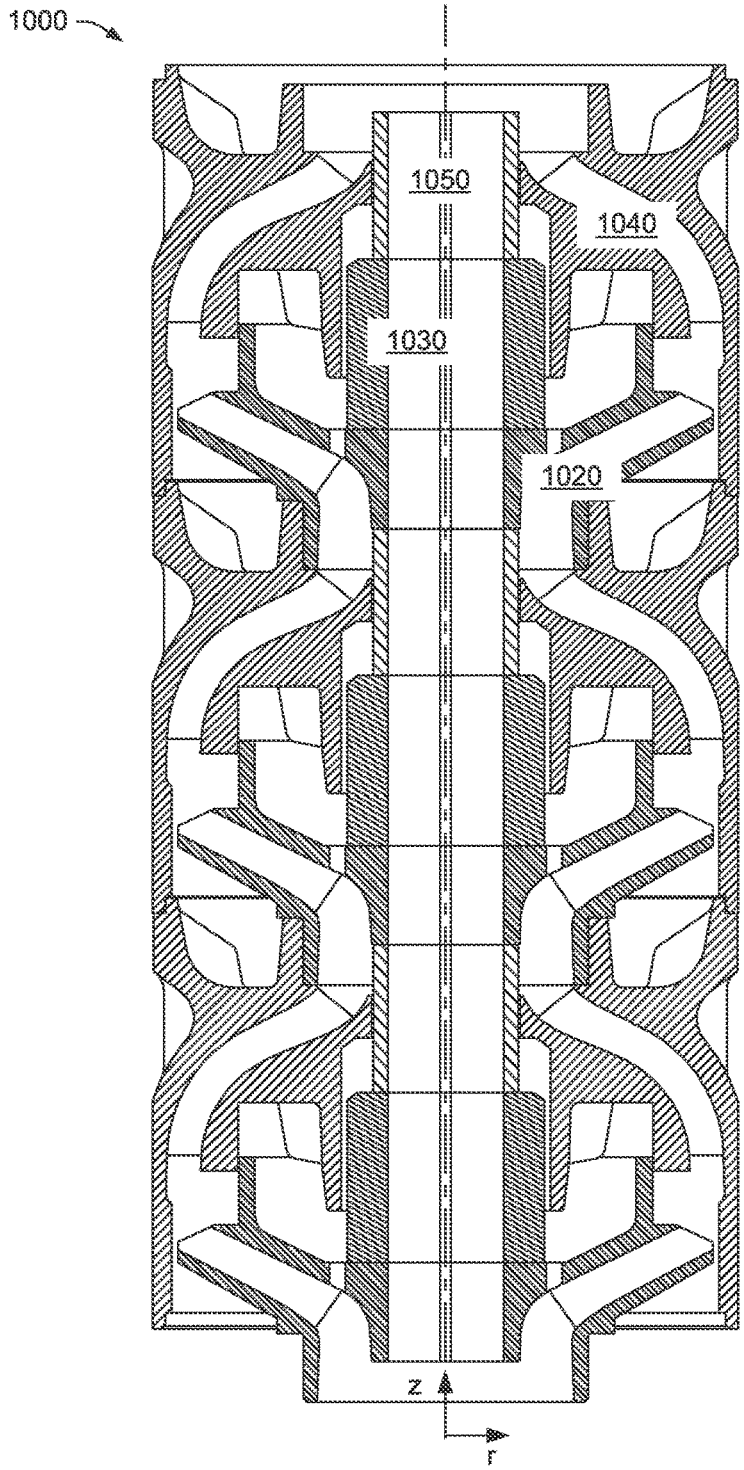
FIG. 10 illustrates an example of an assembly.

FIG. 10 shows a cutaway view of an example of an assembly 1000 that includes three stages where each stage includes an impeller 1020, a first hub spacer 1030, a diffuser 1040 and a second hub spacer 1050.

Figure 11:
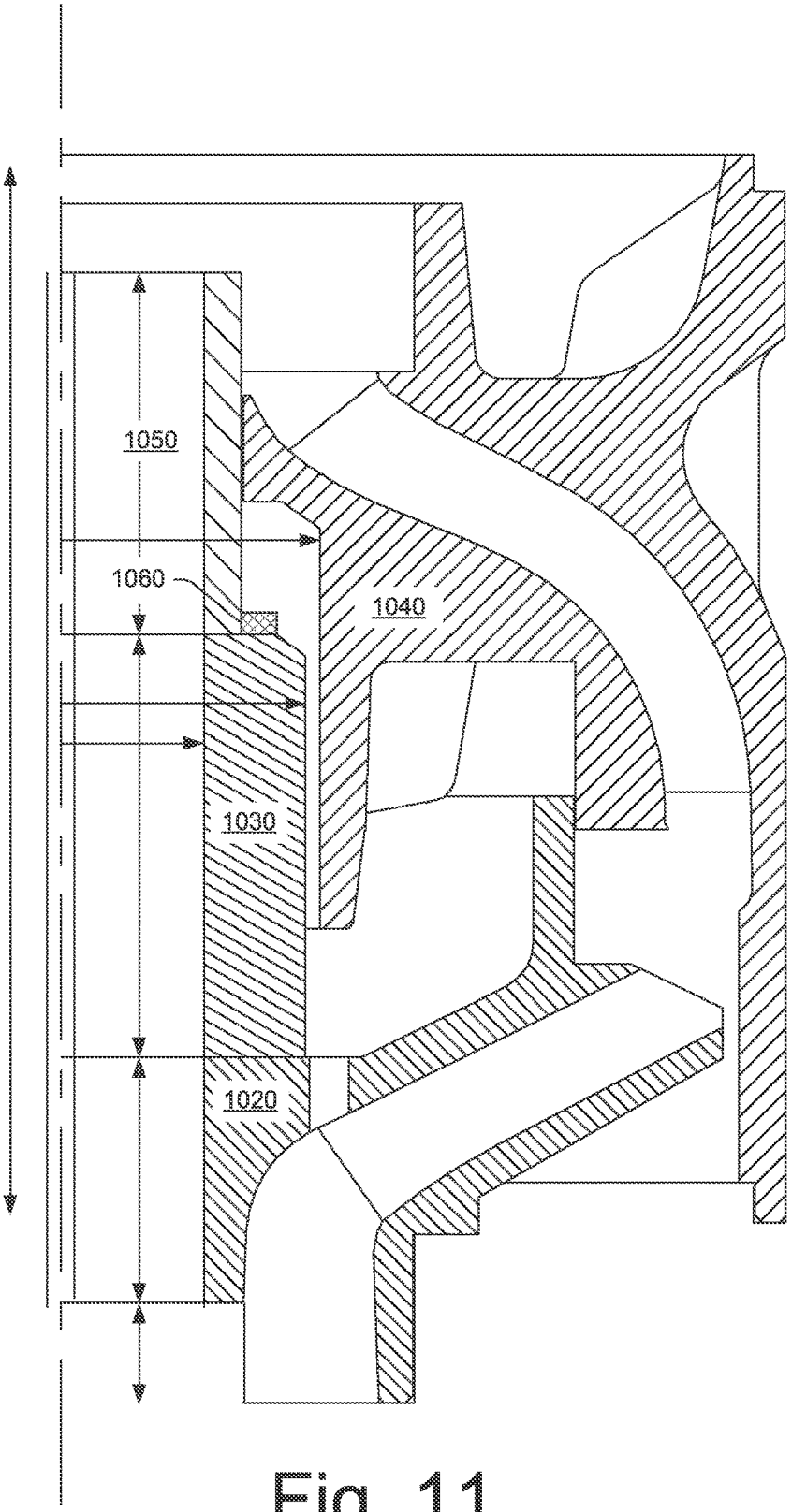
FIG. 11 illustrates an enlarged view of a portion of the example of FIG. 10.

FIG. 11 shows a cutaway view of a portion of the assembly 1000 of FIG. 10. As shown, the first hub spacer 1030 includes an inner diameter and an outer diameter and the second hub spacer 1050 includes an inner diameter and an outer diameter where the outer diameter of the first hub spacer exceeds the outer diameter of the second hub spacer 1050. In such an example, a diffuser pad 1060 (e.g., an thrust washer, etc.) may be located as far inboard, for example, near a diffuser exit to allow for an increased diameter hub spacer.

In the assembly 1000, the stiffnesses of components forming the hub stack may be selected using appropriate materials. Such an approach may, for example, relax or alleviate material constraints as to impeller hub diameter, for example, such that impeller stiffness may be enhanced.

As an example, the diffuser pad 1060 of FIG. 11 may be a non-contact surface (e.g., contact may be controlled by a ring region, near the flow passage area).

In the example of FIG. 11, the diffuser bore may be stepped to include a smaller bore portion and a larger bore portion, for example, where the larger bore portion may accommodate a larger impeller hub.

As an example, one or more components may be made with desired stiffness properties. For example, a spacer may be constructed with a compliance and, for example, a system may include spacers with different compliances. As an example, over a length of a system, component compliance may vary, for example, from one axial end to another axial end. As an example, over a length of a system component stiffness may vary, for example, from one axial end to another axial end.

As an example, a system that includes diffusers may include diffusers with different stiffness values. For example, a diffuser at a lower end of a stack may have a stiffness value that differs from that of a diffuser at an upper end of the stack.

As an example, a system that includes impellers and impeller spacers may include impellers and/or impeller spacers with different compliance values. For example, an impeller and/or an impeller spacer at a lower end of a stack may have a compliance value that differs that of an impeller and/or an impeller spacer at an upper end of the stack.

As an example, a system may include multiple pumps, for example, where each pump is operatively coupled to a shaft of another pump (e.g., or pumps). In such a system, characteristics of the pumps may differ. For example, a lower pump may differ from an upper pump as to, for example, characteristics of diffusers, impellers and/or impeller spacers.

As to compliance and stiffness, stiffness may characterize rigidity of a component, for example, an extent to which it resists deformation in response to an applied force and, for example, compliance may be the inverse of stiffness and given in, for example, meters per newton. As an example, stiffness and/or compliance may be measured when a component is subject to a particular force or forces. Such measurements may be made, for example, at specified temperatures, specified history of a component (e.g., service age, etc.), specified lubricating conditions, specified rotational conditions, etc. For example, an axial stiffness of a rotating component may be measured with respect to an applied axial force while the component is rotating at a particular rotational speed (e.g., rpm, etc.). As an example, stiffness may be stated with respect to applied force and operational limits (e.g., one or more rotational speeds, etc.). As an example, depending on rotational speed, a component may expand radially and, for example, contract axially. In such an example, stresses and strains associated with rotation may be taken into account when selecting a material of construction for a component and/or a shape of a component.

As an example, a component may be made of a material that is characterized in part by its elastic modulus (e.g., an intensive property whereas stiffness may be referred to as an extensive property). As an example, a material of construction with a high modulus of elasticity may be used where deflection is undesirable and a material of construction with a lower modulus of elasticity may provide for increased flexibility. As an example, shape, boundary forces, contact areas, etc. may be considered when constructing a component and, for example, selecting one or more material properties for the component.

Figure 12:
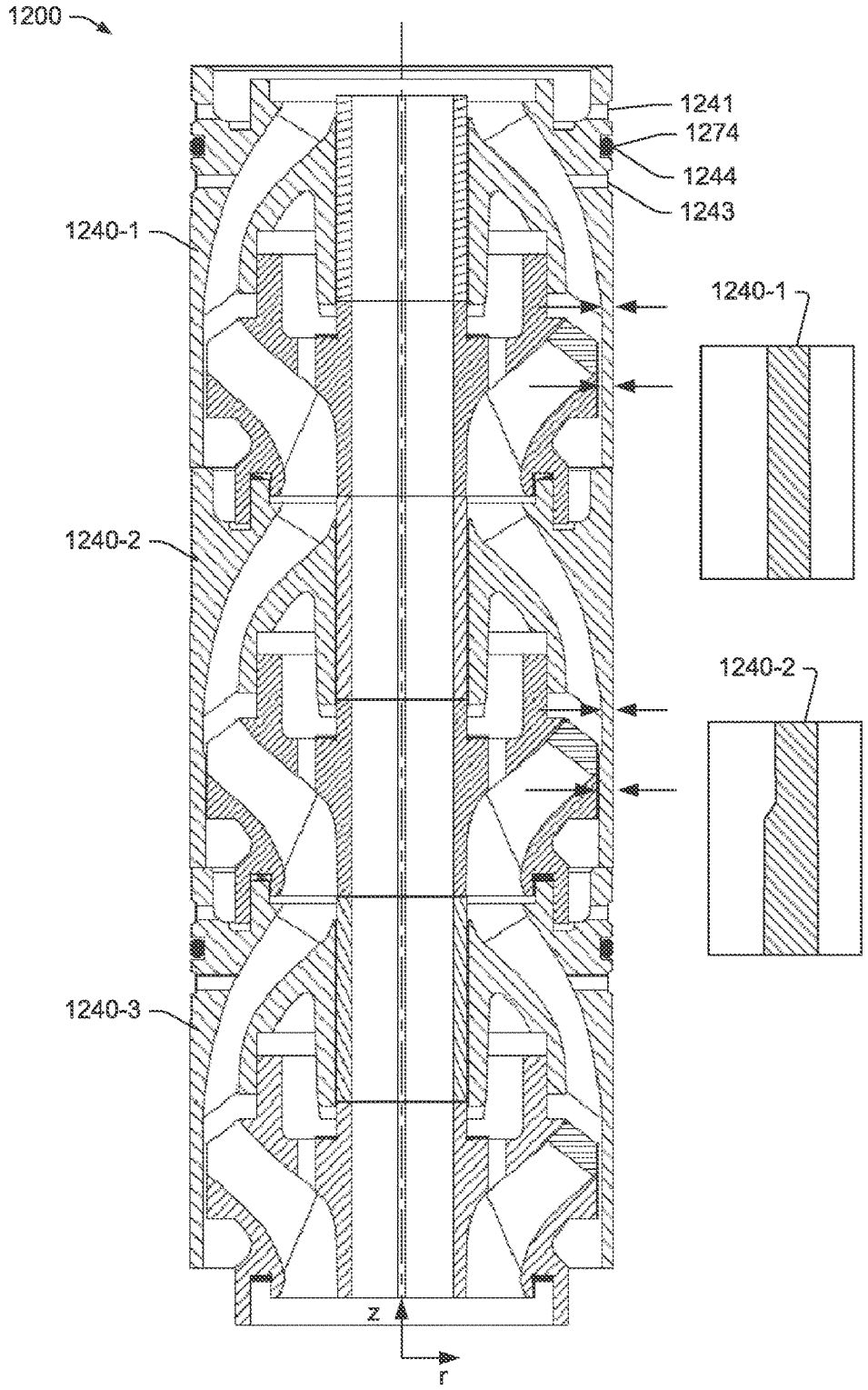
FIG. 12 illustrates an example of an assembly.

FIG. 12 shows an example of an assembly 1200 that includes three diffusers 1240-1, 1240-2 and 1240-3 where the diffusers 1240-1 and 1240-3 include passages 1241 and 1243 at an outer radius. As shown, the diffusers 1240-1 and 1240-3 may include an annular channel 1244, for example, configured to receive a seal element 1274 or seal elements. As an example, a housing may be positioned about the assembly 1200 such that the seal element 1274 forms a seal to seal an upper annular passage and a lower annular passage. Fluid may flow via such annular passages, for example, to help balance fluid pressures.

As shown in the example of FIG. 12, the diffuser 1240-2 includes a wall profile that differs from that of the diffusers 1240-1 and 1240-3. For example, the wall profile of the diffuser 1240-2 may include an inwardly extending portion that may act to form a clearance with an outer portion of an impeller. For example, the profile of a diffuser may be selected to achieve a clearance with respect to an impeller (e.g., to optionally control flow in, to or from a region, a chamber, etc.). A diffuser may include an increased diffuser wall thickness in one or more stages, for example, to minimize the gap between an impeller tip and a diffuser wall. As an example, stages may differ, for example, as shown in FIG. 12. As an example, such an approach may provide for particular flow, pressure balancing, etc. in a series of stages.

As an example, a multistage centrifugal pump can include stages where an individual stage may include an impeller and a diffuser. Such a multistage centrifugal pump may include a stack of stages or stacks of stages (e.g., stacked along a common axis). As an example, in a compression pump or compression ring pump, individual impellers hubs and diffusers shoulders may be compressed, for example, using a compression nut and a grooved spacer tube, respectively. For example, a compression nut may act to compress a stack of impeller hubs and a grooved spacer tube may act to compress a stack of diffusers. As an example, a grooved spacer tube for a stack of diffusers may be a cylindrical wall that may include tangential overlapping slots. In an assembly, such a grooved spacer tube may act to hold diffusers in place and reduce risk of rotation of one or more of the diffusers (e.g., to prevent diffuser spinning).

As an example, techniques to compress diffusers may aim to address effects of thermal phenomena, for example, consider thermal expansion and contraction of materials in an assembly where the materials may have different thermal expansion coefficients (e.g., the thermal expansion coefficient for aluminum oxide ceramics is approximately two and a half times less than the thermal expansion coefficient for steel). As an example, consider a pump section with a housing length of about 6 m assembled at a temperature of about 20 degrees C. that is positioned in a downhole environment at a temperature of about 120 degrees C. In such an example, for a stack of ceramic diffusers in a carbon steel housing, thermal expansion may result in a length difference between the stack and the housing of the order of several millimeters because the housing expands axially more than the stack. The length difference may contribute to a decline in compression force and, depending on the initial stack compression force and housing elongation during assembly, preloading force may drop to an extent that diffusers may become loose (e.g., increasing the risk of diffuser rotation).

As an example, an assembly may include diffusers arranged in a stack that has compliance (e.g., the stack may "float" in a housing). For example, one or more components may be included in the assembly where the one or more components allow the diffusers to translate axially. In such an example, translation of the diffusers in the assembly may track translation of impellers (e.g., if the impellers translate). Such an approach may act to maintain axially alignment between diffusers and impellers.

In addition to compression-style pumps, for example, in which impeller downthrust force may be transferred to a thrust bearing located in a protector (see, e.g., the protector 217 of FIG. 2), floater-style pumps may include impellers that are not clamped or compressed but "float" (e.g., freely along a shaft). As an example, individual impellers in floater-style pump may transfer impeller downthrust to respective diffusers (e.g., where shaft downthrust is still transferred to a thrust bearing in a protector). As an example, a multi-pump string may include stages that are compression-style or floater-style. However, in the case where it is advantageous to use a compression-style pump, like for instance in abrasive service, but the total downthrust of the string may be excessive, a hybrid string of compression-style pumps located at the bottom of a string and floater-style pumps at a top of a string could be used. As an example, a pump string may include compression-style and floater-style equipment, which may be optionally arranged with respect to one or more of an intended direction of impeller rotation, impeller speed, power, head, gravity, etc. As an example, a string may include shafts of pump units in axial contact to transfer shaft thrust load to a protector where, for example, impellers of floater-style pump units may not be compressed or clamped, but rather "float" axially (e.g., as is in a floater-style pump construction).

Figure 13:
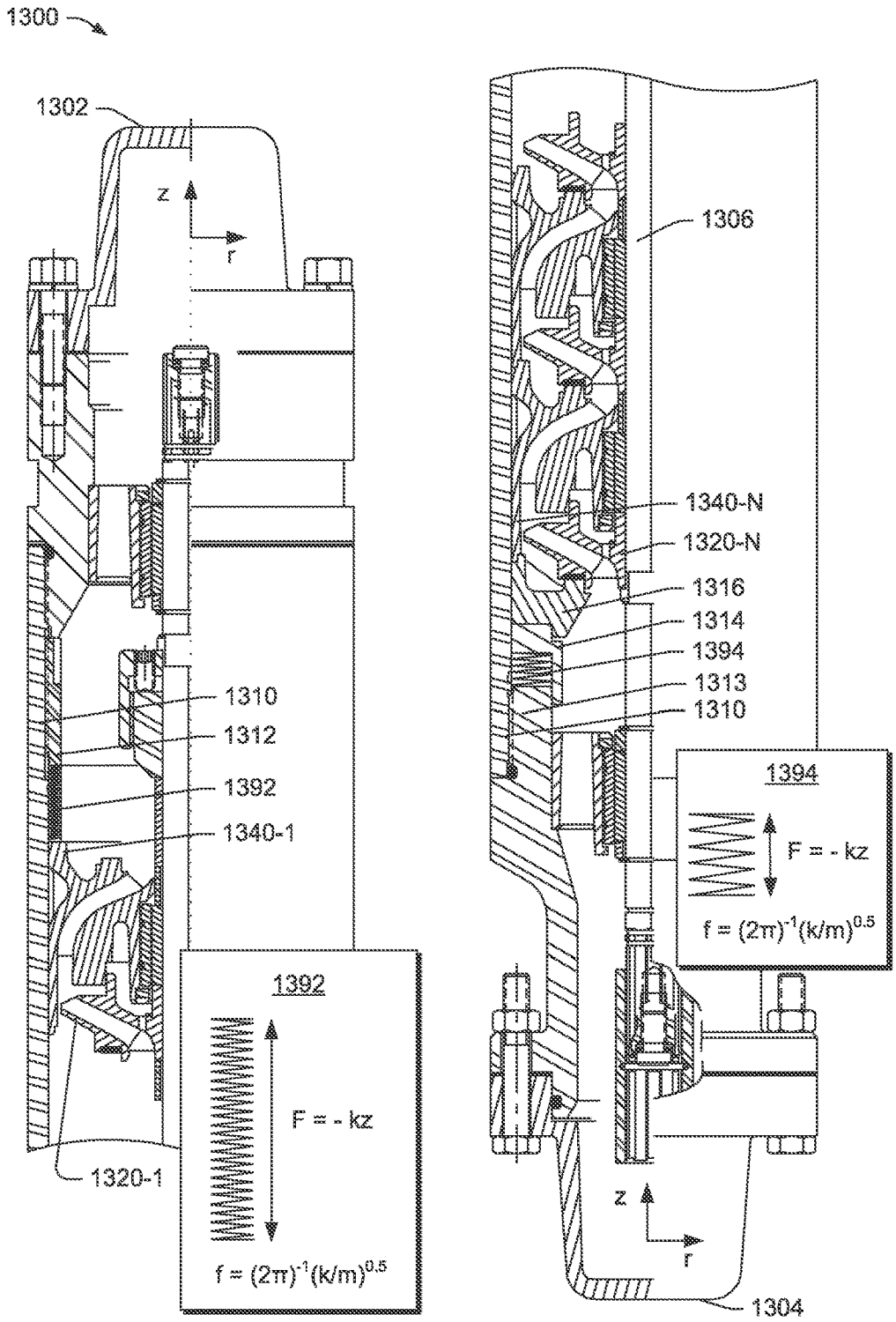
FIG. 13 illustrates an example of an assembly.

FIG. 13 shows an example of an assembly 1300 that includes opposing axial ends 1302 and 1304 and a shaft 1306 operatively coupled to a stack of impellers 1320-1 to 1320-N. The assembly 1300 also includes a housing 1310 and a stack of diffusers 1340-1 to 1340-N.

In the example of FIG. 13, a coupling 1312 may be threaded to inner threads of the housing 1310 to axially position the coupling 1312 with respect to the diffuser 1340-1. As shown, a compliant component 1392 is disposed between a lower end of the coupling 1312 and an upper end of the diffuser 1340-1. As an example, the compliant component 1392 may be characterized, at least in part, by a spring constant. As an example, the compliant component 1392 may be constructed with respect to one or more harmonics, for example, to diminish risk of undesirable harmonics during operation of the assembly 1300. As an example, the compliant component 1392 may be constructed with one or more damping features that act to damp harmonic motion (e.g., a damper that acts to diminish risk of oscillation).

In the example of FIG. 13, a coupling 1313 may be threaded to inner threads of the housing 1310 to axially position the coupling 1313 with respect to the diffuser 1340-N, for example, and optionally one or more intermediate components 1314 and 1316. As shown, a compliant component 1394 is disposed between an upper end of the coupling 1313 and a lower end of the intermediate component 1314. As an example, the compliant component 1394 may be characterized, at least in part, by a spring constant. As an example, the compliant component 1394 may be constructed with respect to one or more harmonics, for example, to diminish risk of undesirable harmonics during operation of the assembly 1300. As an example, the compliant component 1394 may be constructed with one or more damping features that act to damp harmonic motion (e.g., a damper that acts to diminish risk of oscillation).

In the example of FIG. 13, the diffusers 1340-1 to 1340-N may "float" with respect to the housing 1310 via the compliant components 1392 and 1394. As an example, the compliant components 1392 and 1394 may optionally differ in one or more of their respective characteristics. For example, the compliant component 1394 may have a spring constant that differs from that of the compliant component 1392 (e.g., as the compliant component 1394 may experience a higher load depending on orientation of the assembly 1300). As an example, the compliant components 1392 and 1394 may be selected with one or more characteristics to diminish risk of undesirable oscillations of the diffusers 1340-1 to 1340-N.

As an example, the compliant components 1392 and 1394 may be loaded (e.g., pre-loaded during assembly of the assembly 1300). In such an example, loading may be based in part on one or more of intended use of the assembly 1300, expected environmental conditions to which the assembly 1300 may be subjected to during use, number of diffusers, type of diffuser, configuration of diffuser spacers, number of impellers, type of impellers, configuration of impellers, configuration of impeller spacers, motor characteristics, an rpm limit or limits, rpm range, torque, etc.

As an example, during operation of the assembly 1300 (e.g., as a pump), the lower diffuser 1340-N may rest on the lower compliant component 1394 (e.g., indirectly), which may allow the diffuser 1340-N to move downwards, for example, due to hydraulic forces acting on one or more upper diffusers, one or more impeller interactions with one or more diffusers, etc.

As an example, one or more compliant components may be included in an assembly to help manage thermal phenomena, risk of diffuser rotation, risk of inter-component axial gaps, etc.

Figure 14:
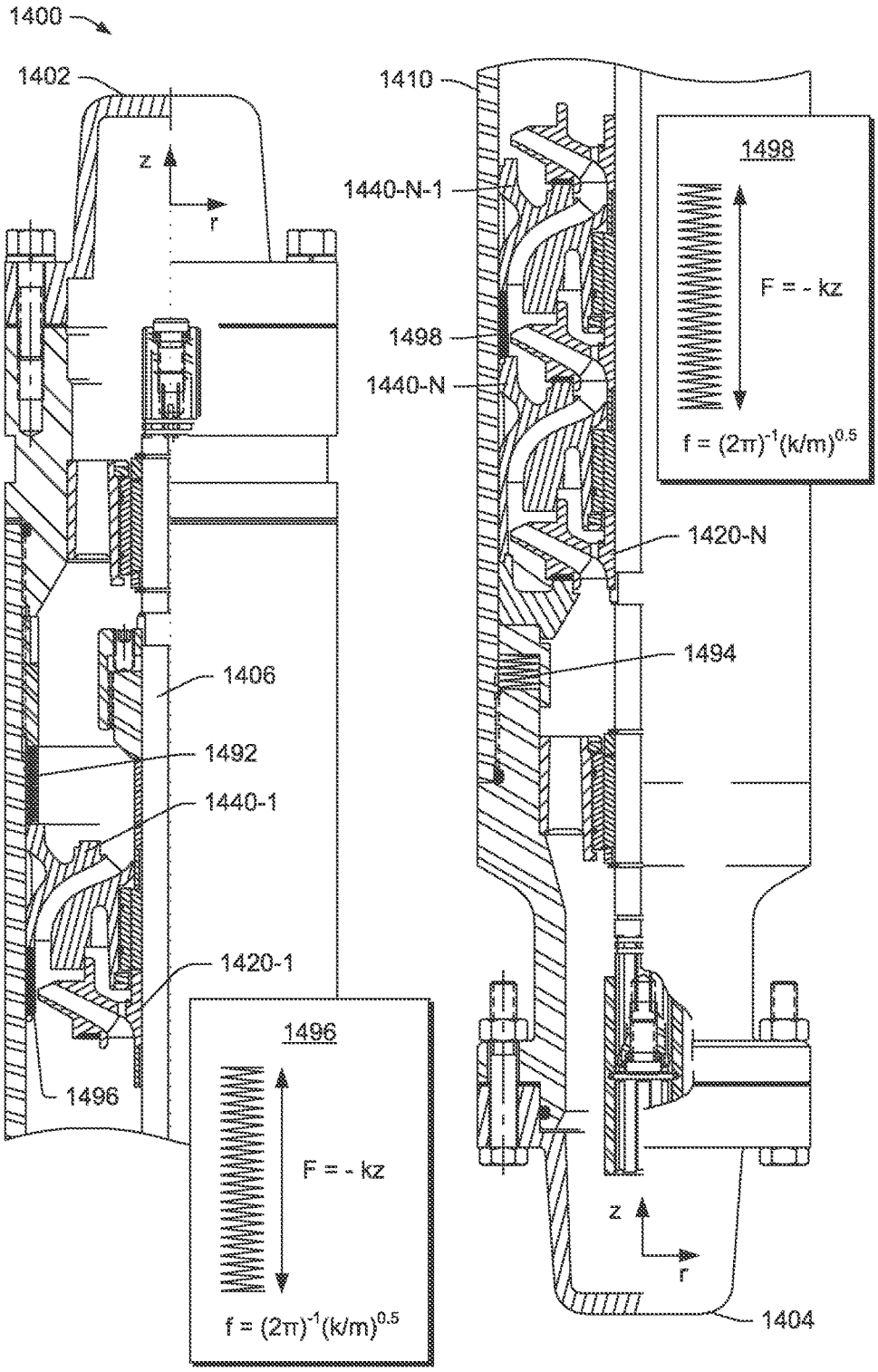
FIG. 14 illustrates an example of an assembly.

FIG. 14 shows an example of an assembly 1400 that includes opposing axial ends 1402 and 1404 and a shaft 1406 operatively coupled to a stack of impellers 1420-1 to 1420-N. The assembly 1400 also includes a housing 1410 and a stack of diffusers 1440-1 to 1440-N.

In the example of FIG. 14, the assembly 1400 may include one or more compliant components 1492, 1494, 1496 and/or 1498. As to the compliant components 1492 and 1494, these may be, for example, the same or similar to the compliant components 1392 and 1394 of the assembly 1300 of FIG. 13.

As to the compliant components 1496 and 1498, these may be inter-diffuser compliant components, for example, positioned axially intermediate the diffuser 1440-1 and the diffuser 1440-N. As shown, the compliant component 1496 is positioned axially below the diffuser 1440-1 and, for example, optionally radially outwardly from the impeller 1420-1. As an example, a diffuser 1440-2 may be positioned axially below the compliant component 1496 such that the compliant component 1496 is positioned and loaded between a surface of the diffuser 1440-1 and a surface of the diffuser 1440-2. As shown in the example of FIG. 14, the compliant component 1498 is positioned axially below the diffuser 1440-N−1 and axially above the diffuser 1440-N.

As an example, the compliant components 1496 and 1498 may be characterized, at least in part, by one or more spring constants. As an example, the compliant component 1496 and 1498 may be constructed with respect to one or more harmonics, for example, to diminish risk of undesirable harmonics during operation of the assembly 1400. As an example, the compliant component 1496 and/or the compliant component 1498 may be constructed with one or more damping features that act to damp harmonic motion (e.g., a damper that acts to diminish risk of oscillation).

In the example of FIG. 14, the diffusers 1440-1 to 1440-N may "float" with respect to the housing 1410 via one or more compliant components such as, for example, one or more of the compliant components 1492, 1494, 1496 and 1498; noting that the assembly 1400 may optionally include more than one intermediate compliant component.

As an example, the compliant components 1496 and 1498 may optionally differ in one or more of their respective characteristics. For example, the compliant component 1498 may have a spring constant that differs from that of the compliant component 1496 (e.g., as the compliant component 1498 may experience a higher load depending on orientation of the assembly 1400). As an example, the compliant components 1496 and 1498 may be selected with one or more characteristics to diminish risk of undesirable oscillations of the diffusers 1440-1 to 1440-N. As an example, where the assembly 1400 includes one or more of the compliant components 1492 and 1494, one or more intermediate compliant components (e.g., such as the compliant components 1496 and 1498) may be selected with one or more characteristics to diminish risk of undesirable oscillations of the diffusers 1440-1 to 1440-N.

As an example, one or more compliant components may be loaded (e.g., pre-loaded during assembly of an assembly). In such an example, loading may be based in part on one or more of intended use of the assembly, expected environmental conditions to which the assembly may be subjected to during use, number of diffusers, type of diffuser, configuration of diffuser spacers, number of impellers, type of impellers, configuration of impellers, configuration of impeller spacers, motor characteristics, an rpm limit or limits, rpm range, torque, etc.

As an example, one or more compliant components may be included in an assembly to help manage thermal phenomena, risk of diffuser rotation, risk of inter-component axial gaps, etc. As an example, one or more compliant components may be included in an assembly such that diffusers are allowed to "float" and, for example, axially translate in a direction in which one or more impellers may translate. In such an example, diffusers may follow impellers with respect to axial excursions thereof within a housing.

As an example, a compliant component may be a spring. As an example, a stack of diffusers may include one or more intermediate compliant components. As an example, a compliant component may be positioned to directly and/or indirectly contact a diffuser or diffusers.

As an example, an assembly may include one or more features of the various examples described herein.

As an example, an assembly may include split rings on impellers. In such an example, split rings may act to disaggregate forces experienced during operation. For example, a split ring may act to transfer forces from an impeller to a shaft. As an example, a split ring may be used on a stage-by-stage or other basis.

As an example, an assembly may include stiffer and shorter shafts in pump string. In such an example, stiffer shafts (or increased OD) for a pump, an intake and a protector may be used.

As an example, a method may include deploying multiple pumps where each pump has a length that may experience a limited amount of force; for example, compared to a long pump that may experience more force, which may impact performance, longevity, etc.

As an example, an assembly may include one or more Impeller hub spacers with a relatively high thermal coefficient. In such an example, impeller hub spacers with high thermal coefficient may act to "lift" impellers upward, which may counteract various forces.

As an example, an assembly may include one or more impellers bolted to a shaft. In such an example, impellers bolted to a shaft may transfer loads from the impellers to the shaft (e.g., to reduce deflections of an impeller).

As an example, an assembly may include a top thrust bearing disposed in a protector with a particular load capacity, for example, to match loads of pinned shafts.

As an example, a method may include operating an electric submersible pump by delivering power to an electric motor to rotate a shaft where impellers of a pump are operatively coupled to the shaft. In such an example, the method may include protecting the electric motor using a protector disposed axially between the pump and the electric motor.

As an example, an electric submersible pump (ESP) can include a shaft; an electric motor configured to rotatably drive the shaft; a housing; a stack of diffusers disposed in the housing; and impellers operatively coupled to the shaft.

As an example, an ESP can include diffusers with ridges and impellers with slots where the ridges include a cross-sectional aspect ratio defined by a ridge width divided by a ridge height where the cross-sectional aspect ratio is less than approximately 1 (see, e.g., the slot 626 and the ridge 646 of the example of FIG. 6A). As an example, an ESP can include diffusers with ridges and impellers with slots where the slots include a cross-sectional aspect ratio defined by a slot width divided by a slot height where the cross-sectional aspect ratio is less than approximately 1 (see, e.g., the slot 626 and the ridge 646 of the example of FIG. 6A).

As an example, an ESP can include diffusers with ridges and impellers with slots where the ridges include a cross-sectional ridge width and a ridge height where the ridge height exceeds the cross-sectional ridge width. As an example, an ESP can include diffusers with ridges and impellers with slots where the slots include a cross-sectional slot width and a slot height where the slot height exceeds the cross-sectional slot width.

As an example, an ESP can include impellers where each of the impellers includes an inner annular lower surface adjacent to a slot adjacent to an outer annular lower surface where a cross-sectional dimension of the outer annular lower surface exceeds a cross-sectional dimension of the inner annular surface (see, e.g., the surface 632, the slot 626 and the surface 636 of the example of FIG. 6A). In such an example, the outer annular lower surface may define, in part, an outer chamber and the inner annular lower surface may define, in part, an inner chamber (see, e.g., the chambers 660 and 680 of the example of FIG. 6A). In such an example, during operation of the ESP, the outer chamber may include a pressure that exceeds a pressure of the inner chamber.

As an example, an ESP may include tolerance rings disposed between impellers and shaft.

As an example, an ESP may include diffusers where at least one of the diffusers includes a stepped bore. In such an example, the stepped bore may include a large diameter bore portion and a small diameter bore portion. In such an example, the ESP may include an impeller spacer, optionally integral with an impeller (e.g., as a hub portion), that includes an outer diameter that exceeds the small diameter of the small diameter bore portion of the stepped bore.

As an example, a diffuser may include an annular face disposed between a large diameter bore portion and a small diameter bore portion of the diffuser. In such an example, an ESP may include a washer configured to abut the annular face.

As an example, an ESP can include an impeller spacer with an annular face and a diffuser with an annular face disposed between a large diameter bore portion and a small diameter bore portion of the diffuser. In such an example, the ESP may include a washer disposed on the annular face of the impeller spacer (e.g., optionally integral to an impeller).

As an example, an ESP can include diffusers where at least one of the diffusers includes a passage disposed in an outer wall for passage of fluid to a clearance between the diffuser and a housing (e.g., where the clearance is defined in part by an outer surface of the diffuser and an inner surface of the housing).

As an example, an ESP may include impellers where at least one of the impellers includes at least one balance hole.

As an example, an ESP may include impellers where at least one of the impellers includes a hub portion with a stiffness greater than a stiffness of a hub portion of another one of the impellers. As an example, an ESP may include impellers, impeller spacers, etc. with different stiffnesses (e.g., arranged along an axis). In such an example, stiffness may vary, for example, where stiffness for a lower stage may differ from stiffness for an upper stage (e.g., where a lower stage may be subject to forces that differ from forces of the upper stage). As an example, an ESP may include impellers and/or impeller spacers with progressively increasing stiffness (e.g., from one end of a pump to another end of a pump). As an example, a pump may include components with greater stiffness at a lower end (e.g., a fluid inlet end) when compared to similar functioning components at an upper end (e.g., a fluid outlet end).

As an example, one or more control modules (e.g., for a controller such as the controller 230, the controller 250, etc.) may be configured to control an ESP (e.g., a motor, etc.) based at least in part on information as to one or more fluid circuits in that may exist between stages of a pump. For example, one or more of backspin, sanding, flux, gas lock or other operation may be implemented in a manner that accounts for one or more fluid circuits (e.g., as provided by diffusers with fluid coupling holes). As an example, a controller may control an ESP based on one or more pressure estimations for a fluid circuit or circuits (e.g., during start up, transients, change in conditions, etc.), for example, where a fluid circuit or circuits may act to balance thrust force.

As an example, a controller may control an ESP based at least in part on one or more features of the ESP. For example, where an ESP includes one or more compliant components (see, e.g., FIGS. 13 and 14), the controller may control the ESP based at least in part on one or more characteristics of the one or more compliant components (e.g., spring constant(s), pre-load, load, number of compliant components, orientation of the ESP with respect to gravity in relationship to one or more of the compliant components, etc.). As an example, a controller may include an input for receipt of information about an ESP, which may include information as to features of the ESP that may act to position diffusers with respect to impellers (e.g., axially), impellers with respect to diffusers (e.g., axially), etc. As an example, power delivered to an ESP may be ramped up, ramped down, limited, modulated, etc. based at least in part on one or more features present in the ESP.

As an example, one or more methods described herein may include associated computer-readable storage media (CRM) blocks. Such blocks can include instructions suitable for execution by one or more processors (or cores) to instruct a computing device or system to perform one or more actions.

According to an embodiment, one or more computer-readable media may include computer-executable instructions to instruct a computing system to output information for controlling a process. For example, such instructions may provide for output to sensing process, an injection process, drilling process, an extraction process, an extrusion process, a pumping process, a heating process, etc.

Figure 15:
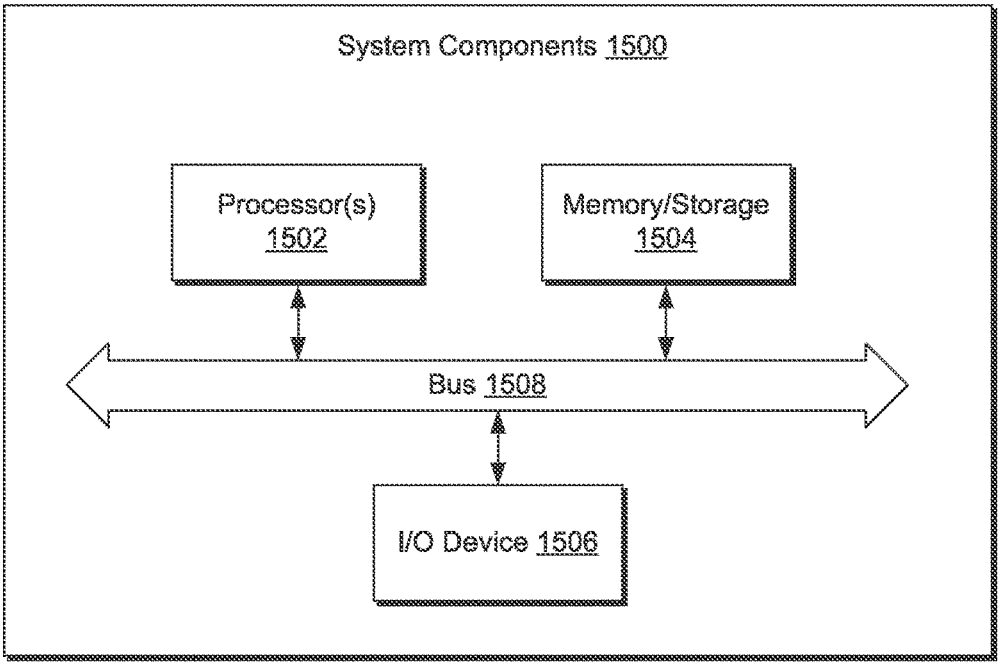
FIG. 15 illustrates example components of a system and a networked system.
Figure 15:
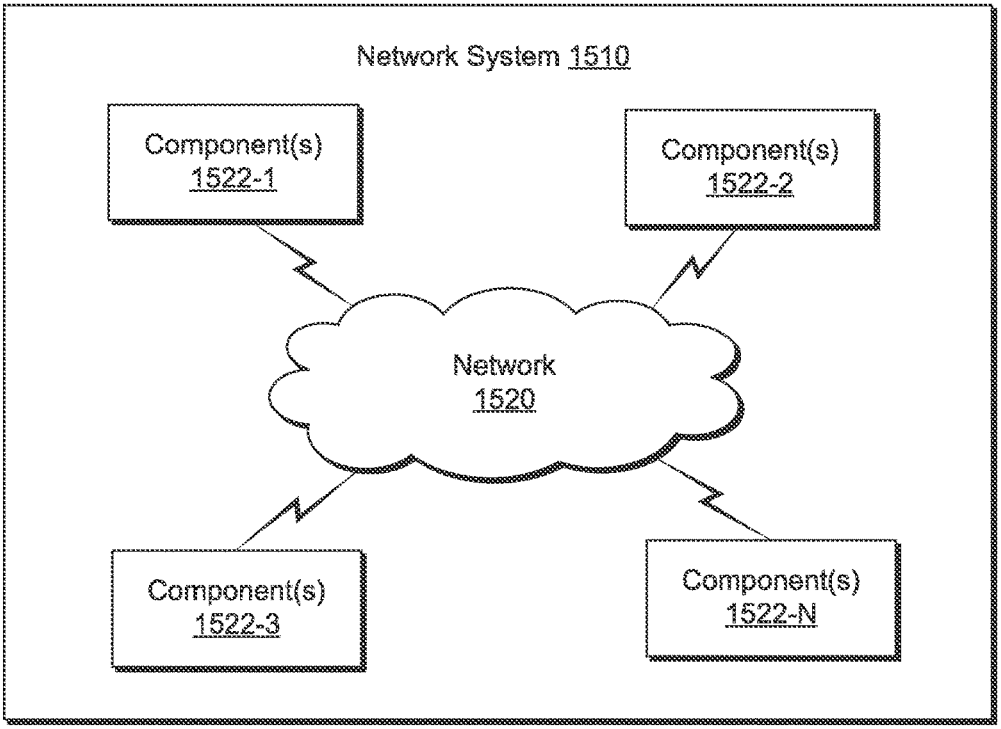

FIG. 15 shows components of a computing system 1500 and a networked system 1510. The system 1500 includes one or more processors 1502, memory and/or storage components 1504, one or more input and/or output devices 1506 and a bus 1508. According to an embodiment, instructions may be stored in one or more computer-readable media (e.g., memory/storage components 1504). Such instructions may be read by one or more processors (e.g., the processor(s) 1502) via a communication bus (e.g., the bus 1508), which may be wired or wireless. The one or more processors may execute such instructions to implement (wholly or in part) one or more attributes (e.g., as part of a method). A user may view output from and interact with a process via an I/O device (e.g., the device 1506). According to an embodiment, a computer-readable medium may be a storage component such as a physical memory storage device, for example, a chip, a chip on a package, a memory card, etc.

According to an embodiment, components may be distributed, such as in the network system 1510. The network system 1510 includes components 1522-1, 1522-2, 1522-3, . . . 1522-N. For example, the components 1522-1 may include the processor(s) 1502 while the component(s) 1522-3 may include memory accessible by the processor(s) 1502. Further, the component(s) 1502-2 may include an I/O device for display and optionally interaction with a method. The network may be or include the Internet, an intranet, a cellular network, a satellite network, etc.

CONCLUSION

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. An electric submersible pump (ESP) comprising:

a shaft;

an electric motor configured to rotatably drive the shaft;

a housing;

a stack of diffusers disposed in the housing; and impellers operatively coupled to the shaft, each of the impellers comprising an inner annular lower surface adjacent to a slot adjacent to an outer annular lower surface, each of the inner annular lower surface and the outer annular lower surface being substantially perpendicular to the shaft, wherein a cross-sectional dimension of the outer annular lower surface exceeds a cross-sectional dimension of the inner annular lower surface, wherein the outer annular lower surface defines, in part, an outer chamber and wherein the inner annular lower surface defines, in part, an inner chamber, and wherein, during operation of the ESP, the outer chamber comprises a pressure that exceeds a pressure of the inner chamber.

2. The ESP of claim 1 wherein the diffusers comprise ridges and the ridges comprise a cross-sectional aspect ratio defined by a ridge width divided by a ridge height, wherein the cross-sectional aspect ratio is less than approximately 1.

3. The ESP of claim 1 wherein the slots of the impellers comprise a cross-sectional aspect ratio defined by a slot width divided by a slot height, wherein the cross-sectional aspect ratio is less than approximately 1.

4. The ESP of claim 1 wherein the diffusers comprise ridges and the ridges comprise a cross-sectional ridge width and a ridge height, wherein the ridge height exceeds the cross-sectional ridge width.

5. The ESP of claim 1 wherein the slots of the impellers comprise a cross-sectional slot width and a slot height wherein the slot height exceeds the cross-sectional slot width.

6. The ESP of claim 1 further comprising tolerance rings disposed between the impellers and the shaft.

7. The ESP of claim 1 wherein at least one of the diffusers comprises a stepped bore.

8. The ESP of claim 7 wherein the stepped bore comprises a large diameter bore portion and a small diameter bore portion.

9. The ESP of claim 8 further comprising an impeller spacer that comprises an outer diameter that exceeds a diameter of the small diameter bore portion of the stepped bore.

10. The ESP of claim 9 wherein the impeller spacer comprises an annular face and wherein the diffuser comprises an annular face disposed between the large diameter bore portion and the small diameter bore portion.

11. The ESP of claim 10 comprising a washer disposed on the annular face of the impeller spacer.

12. The ESP of claim 9 wherein the impeller spacer is integral to an impeller.

13. The ESP of claim 8 comprising an annular face disposed between the large diameter bore portion and the small diameter bore portion.

14. The ESP of claim 13 comprising a washer configured to abut the annular face.

15. An electric submersible pump (ESP) comprising:

a shaft;

an electric motor configured to rotatably drive the shaft;

a housing;

at least one diffuser disposed in the housing, the diffuser comprising a ridge and a stepped bore;

at least one impeller operatively coupled to the shaft, the impeller comprising a slot, wherein a surface of the ridge substantially perpendicular to the shaft and a surface of the slot substantially perpendicular to the shaft define a clearance between the diffuser and the impeller, wherein the impeller comprises an inner annular lower surface adjacent to and radially inward from the slot and an outer annular lower surface adjacent to and radially outward from the slot, each of the inner annular lower surface and the outer annular lower surface being substantially perpendicular to the shaft, and wherein a cross-sectional dimension of the outer annular lower surface exceeds a cross-sectional dimension of the inner annular surface.

16. The ESP of claim 15 wherein the ridge comprises a cross-sectional aspect ratio defined by a ridge width divided by a ridge height wherein the cross-sectional aspect ratio is less than approximately 1.

17. The ESP of claim 15 wherein the slot comprises a cross-sectional aspect ratio defined by a slot width divided by a slot height wherein the cross-sectional aspect ratio is less than approximately 1.

18. The ESP of claim 15, wherein the stepped bore comprises a large diameter bore portion and a small diameter bore portion, further comprising an impeller spacer comprising an outer diameter that exceeds a diameter of the small diameter bore portion.

19. The ESP of claim 18, wherein the impeller spacer comprises an annular face, and wherein the diffuser comprises an annular face disposed between the large diameter bore portion and the small diameter bore portion, further comprising a washer disposed on the annular face of the impeller spacer.

20. The ESP of claim 15, wherein the stepped bore comprises a large diameter bore portion and a small diameter bore portion, further comprising an annular face disposed between the large diameter bore portion and the small diameter bore portion, and a washer configured to abut the annular face.

* * * * *